US009482029B2

(12) United States Patent
Le

(10) Patent No.: US 9,482,029 B2
(45) Date of Patent: Nov. 1, 2016

(54) PADDLE LATCH

(71) Applicant: S.P.E.P. ACQUISITION CORP., Long Beach, CA (US)

(72) Inventor: Tam Le, Santa Ana, CA (US)

(73) Assignee: S.P.E.P. ACQUISITION CORP., Long Beach, CA (US)

( * ) Notice: Subject to any disclaimer, the term of this patent is extended or adjusted under 35 U.S.C. 154(b) by 0 days.

(21) Appl. No.: 14/979,358

(22) Filed: Dec. 22, 2015

(65) Prior Publication Data

US 2016/0108641 A1 Apr. 21, 2016

Related U.S. Application Data

(62) Division of application No. 13/925,744, filed on Jun. 24, 2013, now Pat. No. 9,284,748.

(51) Int. Cl.

| | |
|---|---|
| ***E05B 5/02*** | (2006.01) |
| ***E05B 41/00*** | (2006.01) |
| ***E05B 5/00*** | (2006.01) |
| ***E05B 13/00*** | (2006.01) |
| ***E05B 17/00*** | (2006.01) |
| ***E05B 3/00*** | (2006.01) |
| ***E05B 7/00*** | (2006.01) |
| ***E05B 19/00*** | (2006.01) |

(Continued)

(52) U.S. Cl.

CPC ..... *E05B 5/003* (2013.01); *E05B 3/00* (2013.01); *E05B 5/00* (2013.01); *E05B 7/00* (2013.01); *E05B 13/002* (2013.01); *E05B 17/002* (2013.01); *E05B 19/00* (2013.01); *E05B 41/00* (2013.01); *E05C 3/14* (2013.01); *E05C 3/24* (2013.01); *Y10T 70/5832* (2015.04); *Y10T 292/1062* (2015.04); *Y10T 292/48* (2015.04); *Y10T 292/57* (2015.04)

(58) Field of Classification Search

CPC ..... Y10T 292/57; Y10T 292/1062; Y10T 292/48; Y10T 70/5832; E05B 41/00; E05B 13/002; E05B 17/002; E05B 3/00; E05B 5/00; E05B 5/003; E05B 7/00; E05B 19/00; E05C 3/24; E05C 3/14

USPC ..... 70/208; 292/DIG. 30, 34, 35, 336.3

See application file for complete search history.

(56) References Cited

U.S. PATENT DOCUMENTS

| | | | |
|---|---|---|---|
| 4,320,642 | A | 3/1982 | Pastva, Jr. |
| 4,896,906 | A | 1/1990 | Weinerman et al. |
| 4,911,487 | A | 3/1990 | Rachocki |

(Continued)

*Primary Examiner* — Suzanne Barrett

(74) *Attorney, Agent, or Firm* — Karish & Bjorgum, PC

(57) ABSTRACT

A paddle latch having a pan with a well, a paddle handle, a handle pivot, a rotary latch portion, and a trigger arm arrangement. The paddle handle pivot has a pin that non-rotatably engages with the paddle handle to pivotally attach the paddle handle in the well of the pan and has a pin trigger. The rotary latch portion has a housing containing a rotary hook with a mouth, a rotary trigger, and pin trigger cam. The rotary trigger retains the rotary hook in either an open position where the mouth of the rotary hook is accessible from outside of the housing, or semi-closed or completely closed positions, where the mouth is blocked by the housing. The trigger arm arrangement is adapted to transfer of pivotal movement of the paddle handle to the rotary trigger to release the rotary hook from the semi-closed position or the completely closed position to its open position. Only when the rotary hook is in the semi-closed position will the paddle handle be automatically partially tilted out from the well of the pan.

8 Claims, 25 Drawing Sheets

(51) Int. Cl.
*E05C 3/14* (2006.01)
*E05C 3/24* (2006.01)

(56) References Cited

U.S. PATENT DOCUMENTS

| | | | |
|---|---|---|---|
| 5,046,340 | A | 9/1991 | Weinerman et al. |
| 5,439,260 | A | 8/1995 | Weinerman et al. |
| 5,586,458 | A | 12/1996 | Weinerman et al. |
| 5,611,224 | A | 3/1997 | Weinerman et al. |
| 5,884,948 | A | 3/1999 | Weinerman et al. |
| 5,941,104 | A | 8/1999 | Sadler |
| 6,490,895 | B1 | 12/2002 | Weinerman et al. |
| 6,513,353 | B1 | 2/2003 | Weinerman et al. |
| 6,854,304 | B2 | 2/2005 | Linares |
| 8,347,667 | B2 | 1/2013 | Bacon |
| 8,579,337 | B2 | 11/2013 | Hidding |
| 8,783,075 | B2 | 7/2014 | Matre |
| 9,284,748 | B2 * | 3/2016 | Le ..... E05B 41/00 |
| 2003/0111845 | A1 | 6/2003 | Sadler |

* cited by examiner

PADDLE LATCH

CROSS-REFERENCE TO RELATED APPLICATIONS

This patent application is a divisional patent application of utility application Ser. No. 13/925,744, filed on Jun. 24, 2013.

BACKGROUND OF THE INVENTION

The present invention relates generally to latches, and more particular to a paddle latch with a triggering mechanism that ensures reliable operation.

There currently exist paddle latches that are connected to rotary latch assemblies, either as part of the paddle latch, or connected at a distance thereto by linkages. For example, U.S. Pat. No. 6,513,353 entitled "Lockable Paddle Handle with Disconnect Feature for Operating Remotely Located Latches", discloses embodiments of a lockable paddle handle designed to function with a single rotary latch, or multiple rotary latches. The paddle handles of the '353 patent include a first and a second arms, each of which has an elongated slot formed therein, and a coaxial mounting hole to pivotally mount each of the first and second arms to a housing of the paddle latch. The first arm has an enlarged inner end region communicating with the end of its slot that is near the coaxial mounting hole. The second arm has a pawl formation opposite the slot, with its mounting hole located therebetween. The first and second arms overly each other with their slots being generally aligned. A locking link is connected at one end to the key lock, and the locking link extends from a second end thereof, which pin passes through the slots formed in the first and second arms. When the key lock is turned to the locked position, the pin on the locking link will remain in the inner end region of first arm. In this state, when the handle is lifted, a projection on the handle will push on the first arm, but will not cause movement of the second lever. However, when the key lock is turned to the unlocked position, the pin on the locking link will move out of the inner end region of first arm and into the slots in the first and second arms. In this state, when the handle is lifted, a projection on the handle will push on the first arm, and due to the pin being in the two slots, the second lever will pivot, and the pawl on the second lever will activate the rotary latch and cause it to open. There are problems with the latch of the '353 patent including that activation of the rotary latch is quite sensitive to the position of the key lock, and even if the key lock is slightly turned to the open position, even such that a user may not realize that the key lock is open, movements of the handle can cause the rotary latch to open up. A further shortcoming of the paddle latch of the '353 patent is that it has a slot formed in the bottom of the well of its housing through which freely passes a handle projection. This slot would allow the ingress of water through the paddle latch.

There is another shortcoming with current designs of paddle latches, namely, that it can be difficult to discern, particularly at a distance and at a glance, whether the door to which the paddle latch is attached is completely closed. Thus for example, in the case of utility trucks, which may have several paddle latches on tools bins and storage boxes, the doors carrying the paddle handles frequently include rubber sealing gaskets around a perimeter thereof to provide for sealing with cabinet frame. These seals can sometimes make it difficult to completely close the doors on the frame, and thus users still need to check each and every door to determine if the door is completely closed. This is usually done by pushing each door into contact with the cabinet frame to see if the door will close any further, which can take extra time and effort.

There accordingly remains a need for a paddle latches that are less sensitive to the position of its key locks, provide users with better feedback as to the open and closed state of the paddle latches, and latches that are more resistant to the passage of liquid through the paddle latches.

SUMMARY OF THE INVENTION

A paddle latch, comprising:

a pan with a well;

a paddle handle;

a handle pivot including a pin that non-rotatably engages with the paddle handle to pivotally attach the paddle handle in the well of the pan, and a pin trigger that is retained outside of the well;

a rotary latch portion comprising a rotary hook with a mouth, a rotary trigger, springs to bias the rotary hook and rotary trigger, a housing for the rotary hook, and a pin trigger cam in the form of a generally planar plate that is pivotally connected to the housing generally perpendicularly to the rotary hook, the pin trigger cam having a bar extending generally perpendicularly at one end of the planar plate and a slanted edge on another end, wherein the bar extends through the elongate slot in the handle pivot, wherein the rotary trigger retains the rotary hook in one of a plurality of position including an open position where the mouth of the rotary hook is accessible from outside of the housing, a semi-closed position, and a completely closed position, wherein in the semi-closed position and the completely closed position the mouth is blocked by the housing; and a trigger arm arrangement pivotally attached to the pan adapted to transfer of pivotal movement of the paddle handle to the rotary trigger of the rotary latch portion to release the rotary hook from the semi-closed position or the completely closed position so it moves to the open position;

wherein when the rotary hook is in the semi-closed position, the paddle handle will be partially tilted out from the well of the pan without being manually lifted by a user, and wherein when the rotary hook is in either the opened position or the completely closed position, the paddle handle will not be partially tilted out from the well of the pan.

The invention further provides a paddle latch, comprising:

a pan with a well;

a paddle handle;

a handle pivot including a pin that non-rotatably engages with the paddle handle to pivotally attach the paddle handle in the well of the pan, and a pin trigger that is retained outside of the well;

a rotary latch portion comprising a rotary hook with a mouth, a rotary trigger, springs to bias the rotary hook and rotary trigger, a pin trigger cam, and a housing for the rotary hook, the rotary trigger, and the springs, wherein the rotary trigger retains the rotary hook in one of a plurality of positions including an open position where the mouth of the rotary hook is accessible from outside of the housing, a semi-closed position, and a completely closed position, wherein in the semi-closed position and the completely closed position the mouth is blocked by the housing, and wherein the pin trigger cam is pivotally connected to the housing generally perpendicularly to the rotary hook, the pin trigger having a nose on one side and a slanted edge on another side, and wherein the pin trigger is aligned with the rotary hook such that when the rotary hook is in the semi-closed position the rotary hook will impinge on the slanted edge of the pin trigger causing the pin trigger to rotate and engage with its nose against the pin trigger of the handle pivot to cause the pin to rotate, thereby partially tilting the paddle handle out from the well of the pan without being manually lifted by a user, and wherein when the rotary hook is in either the opened position or the completely closed position, the pin will not engage with the pin trigger and therefore the paddle handle will not be tilted out from the well of the pan; and a trigger arm arrangement pivotally attached to the pan and adapted to transfer pivotal movement of the paddle handle to the rotary trigger of the rotary latch portion to release the rotary hook from the semi-closed position or the completely closed position to the open position;

wherein when the rotary hook is in the semi-closed position, the paddle handle will be partially tilted out from the well of the pan without being manually lifted by a user, and wherein when the rotary hook is in either the open position or the completely closed position, the paddle handle will not be partially tilted out from the well of the pan.

The invention yet further provides a paddle latch, comprising:

a pan with a well and a rim, the pan having an upper surface and a lower surface;

a paddle handle with a pivot end with a non-round hole formed therethrough, and a grip portion opposite the pivot end;

a key lock with a key lock cam, the key lock located in the rim of the pan and the key lock cam extending below the lower surface of the pan;

a handle pivot including a non-round pin that non-rotatably passes through the non-round hole formed in the pivot end of the paddle handle to pivotally attach the paddle handle in the well of the pan, and a pin trigger that is retained outside of the well on the lower surface thereof;

a rotary latch portion affixed to the lower surface of the pan, comprising a rotary hook with a mouth, a rotary trigger, springs to bias the rotary hook and rotary trigger, a pin trigger cam, and a housing for the rotary hook, the rotary trigger, and the springs, wherein the rotary trigger retains the rotary hook in one of a plurality of position including an open position where the mouth of the rotary hook is accessible from outside of the housing, a semi-closed position, and a completely closed position, wherein in the semi-closed position and the completely closed position the mouth is blocked by the housing, and wherein the pin trigger cam is pivotally connected to the housing generally perpendicularly to the rotary hook, the pin trigger having a nose on one side and a slanted edge on another side, wherein the pin trigger is aligned with the rotary hook such that when the rotary hook is in the semi-closed position the rotary hook will impinge on the slanted edge of the pin trigger causing the pin trigger to rotate and engage with its nose against the pin trigger of the handle pivot to cause the pin to rotate, thereby partially tilting the paddle handle out from the well of the pan without being manually lifted by a user, and wherein when the rotary hook is in either the opened position or the completely closed position, the pin will not engage with the pin trigger and therefore the paddle handle will not be tilted out from the well of the pan; and\ a trigger arm arrangement pivotally attached to the pan adapted to transfer of pivotal movement of the paddle handle to the rotary trigger of the rotary latch portion to release the rotary hook from the semi-closed position or the completely closed position so it moves to the open position;

wherein when the rotary hook is in the semi-closed position, the paddle handle will be partially tilted out from the well of the pan without being manually lifted by a user, and wherein when the rotary hook is in either the opened position or the completely closed position, the paddle handle will not be partially tilted out from the well of the pan.

DETAILED DESCRIPTION

Figure 1A:
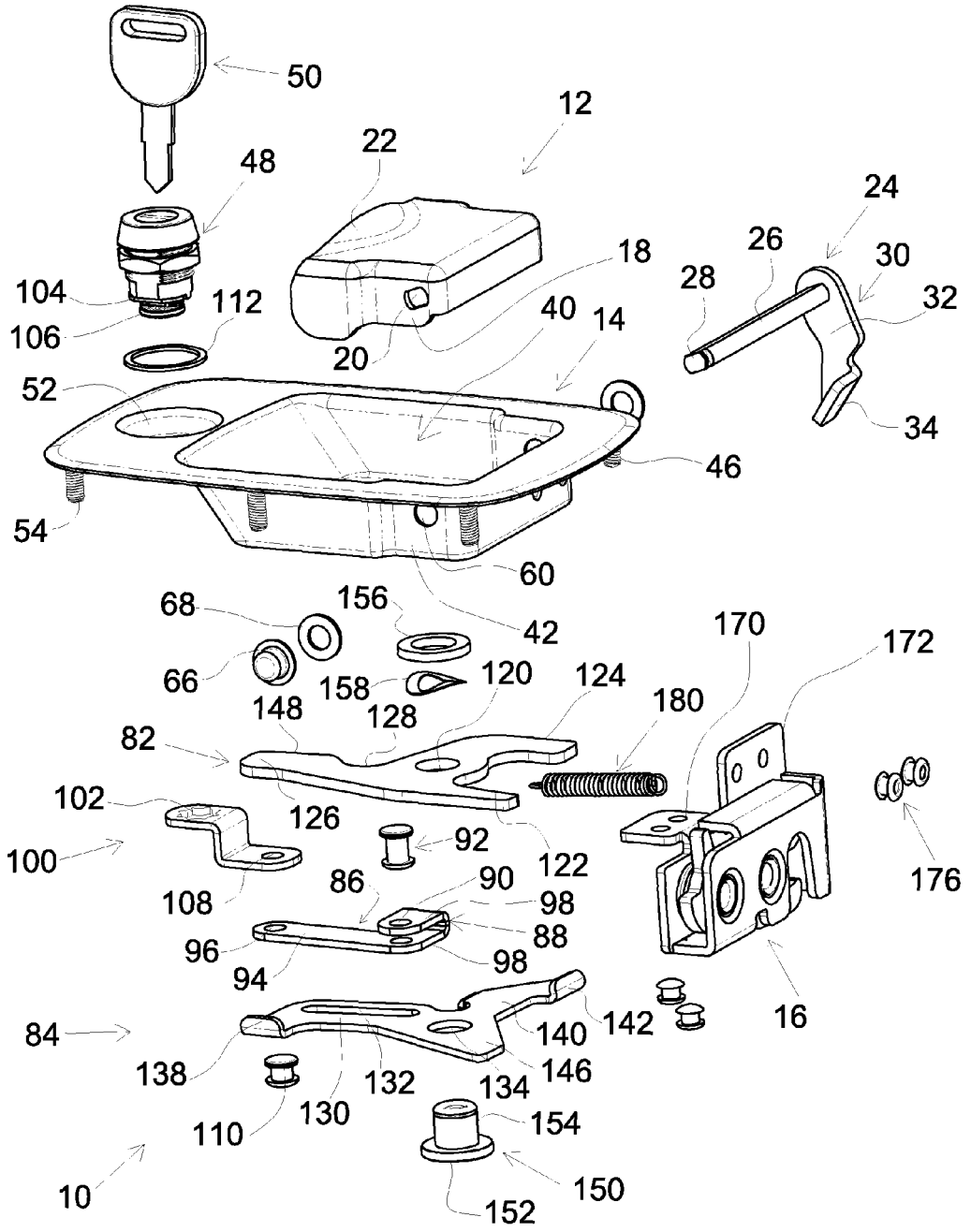
FIG. 1A is a front top exploded view of an exemplary embodiment of a paddle latch of the invention.
Figure 1B:
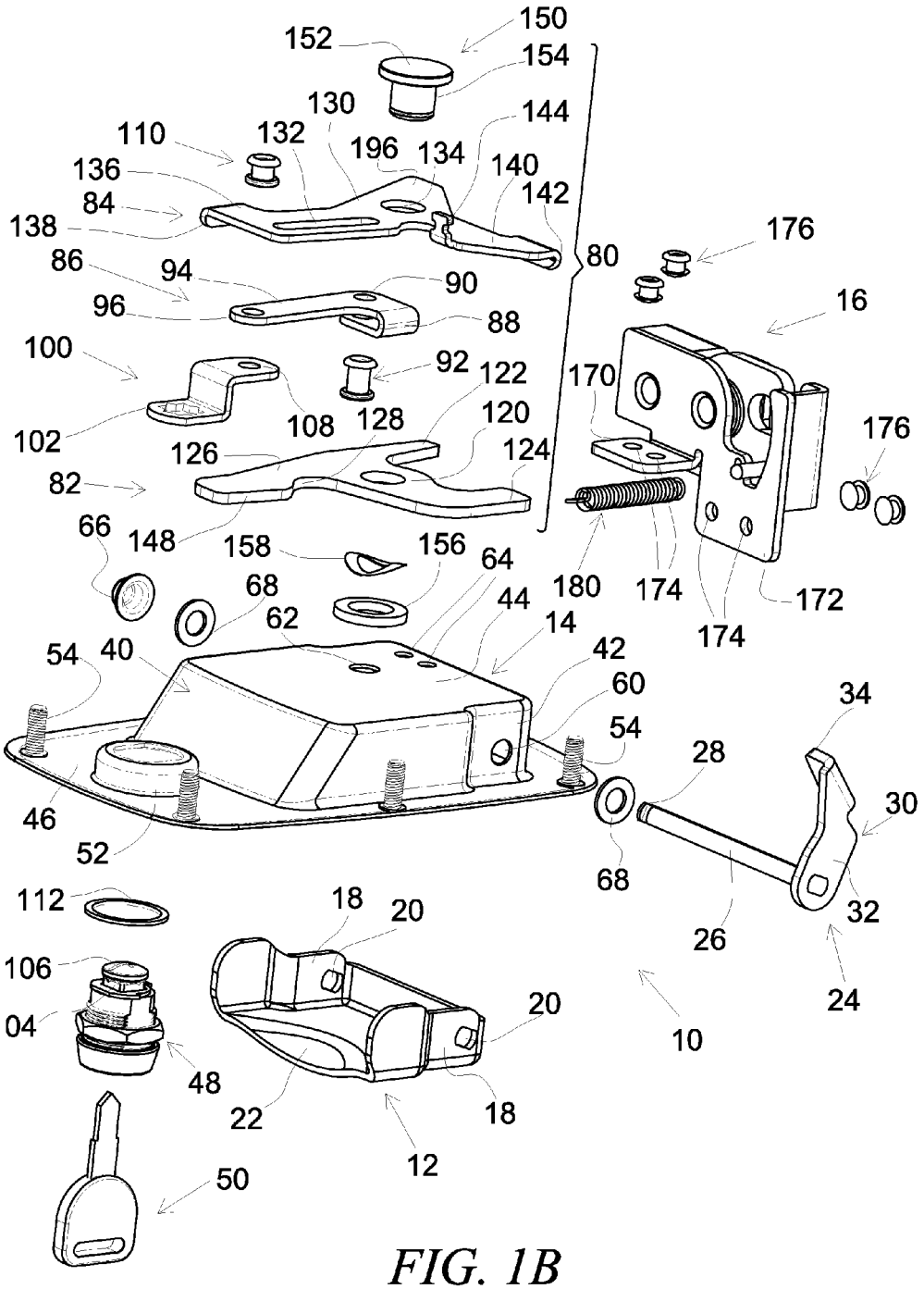
FIG. 1B is a rear bottom exploded view of an exemplary embodiment of a paddle latch of FIG. 1A.

Turning first to FIGS. 1A and 1B, there are shown a front top and rear bottom exploded views, respectively, of an exemplary embodiment of a paddle latch 10 of the invention. Main components of the paddle latch include a paddle handle 12, a pan 14, and a rotary latch 16. The paddle handle 12 has sides 18 with non-round openings 20 formed therethrough. A grip portion 22 is located at an opposite end of the non-round openings. A handle pivot 24 is used to pivotally connect the paddle handle 12 to the pan 14. The handle pivot 24 has a pin 26 with a free end 28. An opposite end of the pin 26 is fixed to a pin trigger 30. The pin trigger 30 can have a flat body portion 32 with a bent over slanted end 34 that is provided at an end of the pin trigger 30 distant from the attachment point of the pin 26. The pin trigger 30 can be a section of metal or plastic with the bent over slanted end 34. The pin 26 can have a non-round cross-section so that when the pin 26 is slid through the non-round openings 20 formed in the handle, pivotal movement of the paddle handle 12 rotates the handle pivot 24 and its pin trigger 30. However, so long as the pin 26 is prevented from rotating relative to the openings 20 in the sides 18 of the paddle handle 12, the cross-sectional shape of the pin can be as desired. The pan 14 has a well 40 formed therein, which is sized to receive the paddle handle 12. The well 40 has opposite parallel side wall section 42 and a bottom 44. A rim 46 extends around an upper end of the well 40. In versions of the paddle latch including a key lock 48 and key 50, a key cylinder opening 52 is formed in the rim 46. In order to provide attachment points of the paddle latch 10 to door or other item to which the paddle latch 10 will be affixed (not shown), threaded studs 54 can be provided. However, other types of devices could be used instead. Pin apertures 60 are formed in the side wall section 42 and are sized to slideably and rotatably receive the pin 26. Passing through the bottom 44 of the well 40 can be a rivet receiving hole 62 and rotary latch rivet holes 64. A pin cap 66 can be provided that is sized to engage with the free end 28 of the non-round pin 26. To help prevent the passage of liquid or other material from passing through the pin apertures 60 and into the well 40 of the pan 14, seal washers 68 are preferably provided to ride on an outside surface of the side wall section 42 of the well 40 and be sandwiched by the flat body portion 32 of the pin trigger 30 and the seal washers 68. The non-round pin 26 will be rotatably passed through the pin apertures 60 in the opposite parallel side wall sections 42 of the well 40, and non-rotatably pass through the non-round openings 20 formed in the handle 12. As thus assembled, pivoting of the handle 12 relative to the pan 14 causes the pin trigger 30 to also rotate in concert. Pivotally attached to the bottom 44 of the well 40 is a trigger arm arrangement 80, made up of several components, include a trigger arm 82, a cam arm 84, and a linkage arm 86. The linkage arm 86 has a bent over end 88 with holes 90 that pass therethrough, which holes 90 receive a linkage arm rivet 92. An opposite end 94 of the linkage arm 86 has an attachment point 96, such as a through hole. The bent over end 88 has two spaced apart walls 98 and when the linkage arm rivet 92 is fitted into the holes 90, it will bridge the two spaced apart walls 98. The two spaced apart walls 98 are spaced apart a distance that is large enough to slideably receive the cam arm 84, as will be described further below. A lock cam 100 is provided, which has a first end with a non-round aperture 102 which is adapted to be fitted to a turning end 104 of the key lock 48, e.g., with a screw 106. When the key lock 48 is turned, the lock cam 100 will accordingly also turn. The lock cam 100 has a second end with an aperture 108. When the paddle handle 10 is assembled, a lock cam rivet 110 will pass through the attachment point (through hole) 96 in the linkage arm 86 and the aperture 108 in the lock cam 100, thereby pivotally connecting together the linkage arm 86 and the lock cam 100. A seal 112, such as a rubber washer or O-ring can be used to secure the key lock 48 in the key cylinder opening 52. Turning back to the trigger arm 82, it has a trigger arm pivot point, such as a round hole 120, a trigger leg 122, and a stop leg 124, and an activation leg 126, the purposes of which will be described in greater detail below. The activation leg 126 has a relief area 128 closer to the round hole 120 and a protrusion area 148 further away from the round hole 120. The activation leg 126 has a leading edge 126*a* and a trailing edge 126*b*. The trigger arm 82 is preferably flat, and can be made of strong material, such as steel. The cam arm 84 has generally planar body 130 with an elongate slot 132 formed therethrough. A cam arm pivot point, such as a round hole 134 is formed through the generally planar body 130. The elongate slot 132 has a first end 132*a* that is closer to the round hole 134 than is its second end 132*b*. Extending next to the elongate slot 132 is a first extension arm 136 which has a turned down pull tab 138. Distant from the elongate slot 132 is a second extension arm 140 with a turned down push tab 142. A spring retainer 144, e.g., in the form of a turned up tab can be located on the second extension arm 140. The cam arm 84 also has a stop leg 146. When assembled, a trigger arm arrangement rivet 150 is used to pivotally retain the cam arm 84 over the linkage arm 86. The trigger arm arrangement rivet 150 has a generally flat head 152 and a cylindrical shaft 154. The cylindrical shaft 154 will pass through cam arm pivot round hole 134 and through the trigger arm pivot round hole 120 and be permanently secured in the rivet receiving hole 62 in the bottom 44 of the well 40. A bearing washer 156 and wave spring 158 can be placed between the bottom 44 of the well 40 and an underside surface of the trigger arm 82 to ensure smooth but wobble-free movement of the components. The rotary latch 16 has bracket portions 170 and 172 with holes 174 that can be used to permanently fix the rotary latch 16 to the pan 14 using fixtures, such as rivets or screws 176. A return spring 180 hooks on between the rotary latch 16 and the spring retainer 144 of the cam arm 84 to bias the second extension arm 140 and its turned down push tab 142 towards the rotary latch.

Figure 2:
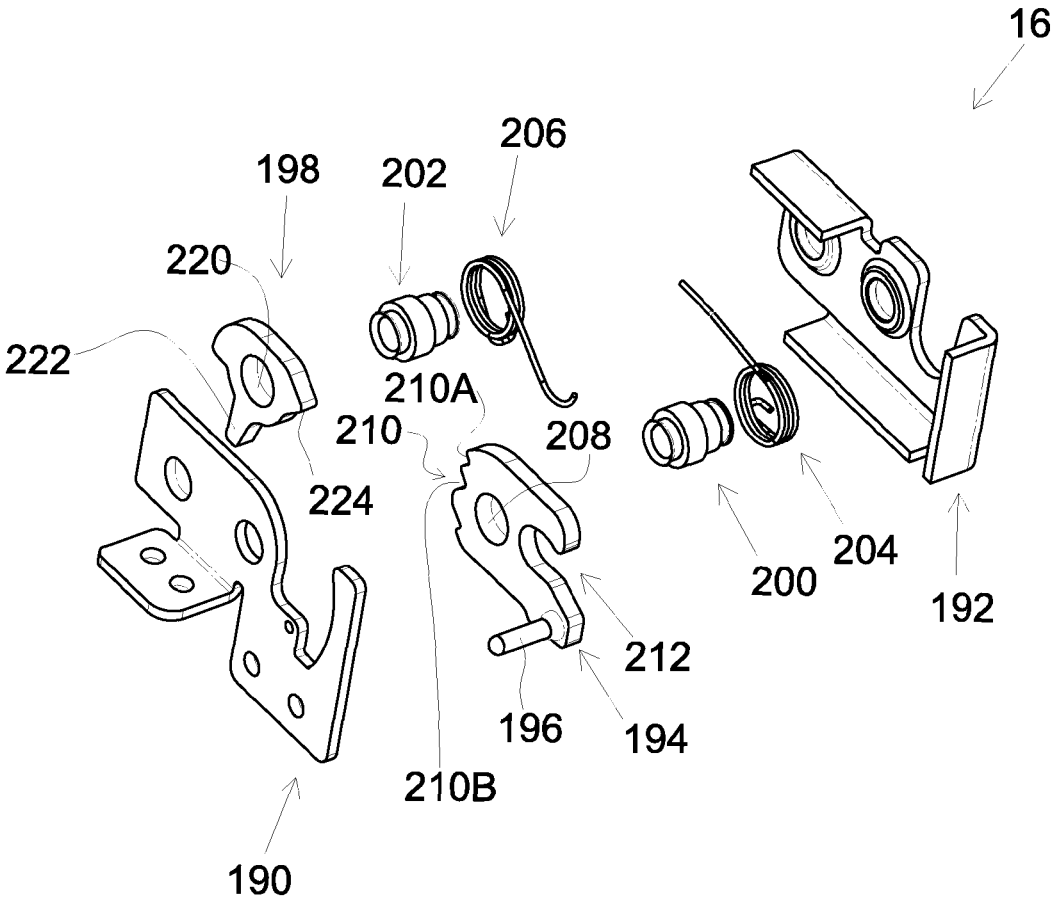
FIG. 2 is an exploded view of an exemplary rotary latch of the paddle latch of FIGS. 1A and 1B.

Turning now to FIG. 2, there is shown an exploded view of the exemplary rotary latch 16 of the paddle latch 10 of the invention. The exemplary rotary latch 16 includes a rotary bottom housing 190 and a rotary top housing 192. Located in the rotary bottom housing 190 and a rotary top housing 192 when they are assembled is a rotary hook 194 that has a pin 196, a rotary trigger 198, a rotary hook step spacer 200, a rotary trigger step spacer 202, and spring actuators 204 and 206 for asserting a rotational biasing force on the rotary hook 194 and the rotary trigger 198, respectively. The rotary hook 194 has a pivot hole 208 for pivoting on the rotary hook step spacer 200, and has steps 210 formed on an end opposite a mouth 212 which is adapted to engage with a catch that will be mounted on a door frame (not shown). There are preferably two steps 210A and 210B provided. The rotary trigger 198 has a pivot hole 220 for pivoting on the rotary hook step spacer 202. The rotary trigger 198 has a trigger finger 222 at a lower end and a nose 224 that can engage with one of the steps 210. Depending on which step is engaged with the nose 224 of the rotary trigger 198, the position of the rotary hook 194 will be two slightly different closed positions of the mouth 212. In the orientation as shown, the spring actuators 204 and 206 tend to bias the rotary hook 194 and the rotary trigger 198, counter-clockwise and clockwise, respectively. The significance of this will be explained further below.

Figure 3A:
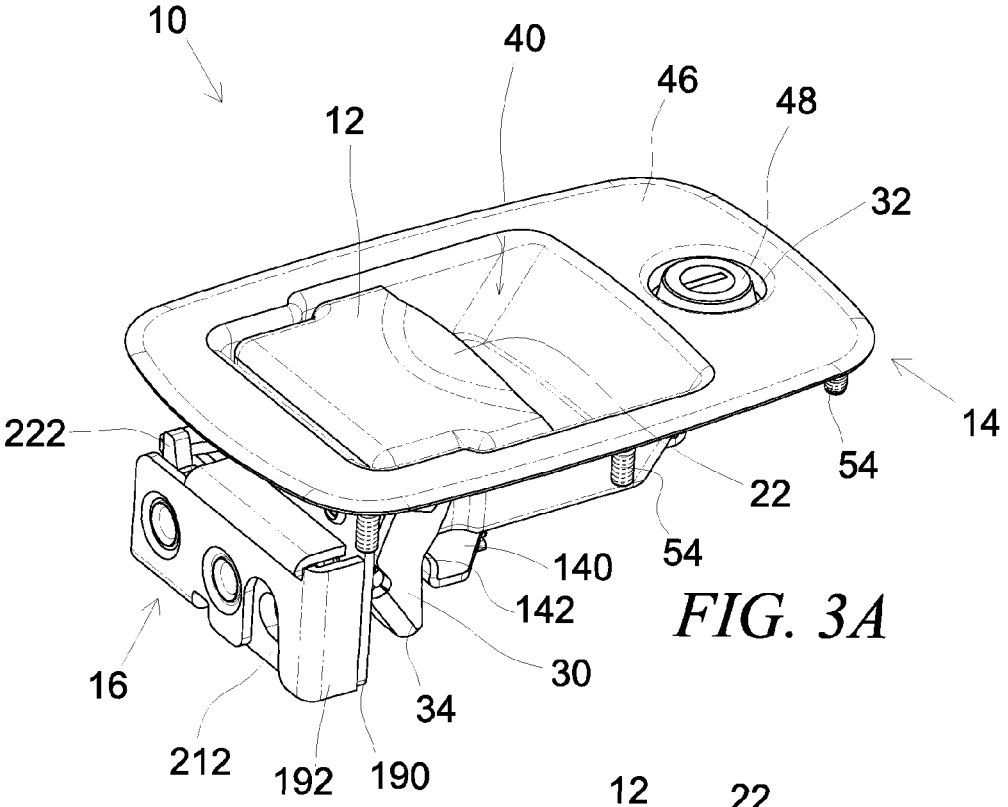
FIG. 3A is a front bottom isometric view showing the assembled paddle latch of FIGS. 1A and 1B.
Figure 3B:
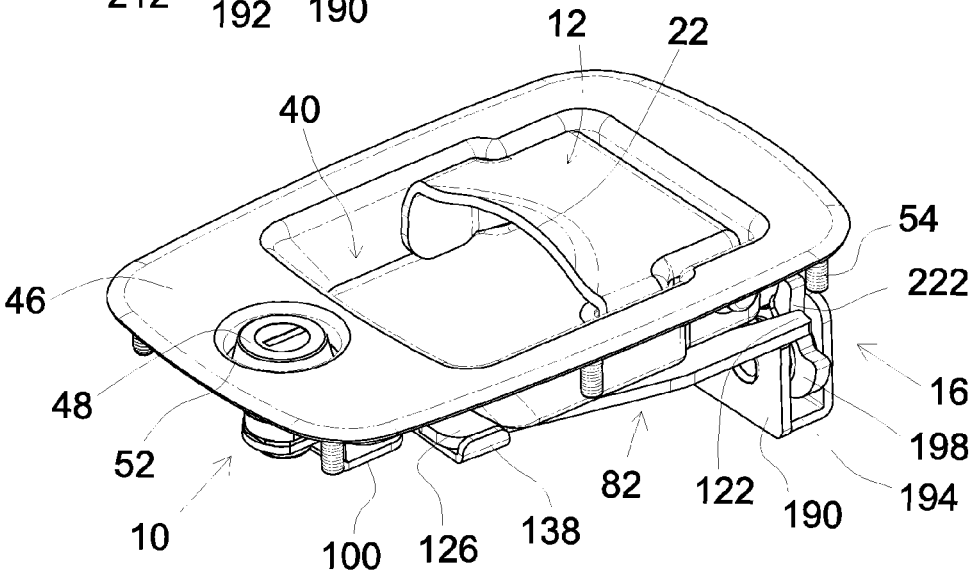
FIG. 3B is a front top isometric view showing the assembled paddle latch of FIGS. 1A and 1B.

FIG. 3A is a front bottom isometric view and FIG. 3B is a front top isometric view showing the assembled paddle latch 10 of the invention of FIGS. 1A and 1B. The paddle handle 12 with its grip 22 is shown positioned in the well 40 of the pan 14. The key lock 48 is positioned in the key cylinder opening 52 in the pan's rim 46. Threaded studs 54 are shown extending below the rim 46. The rotary latch 16 is fixed to the pan 14. These figures show the pin trigger flat body portion 30 and bent over slanted surface 34 riding against the turned down push tab 142 of the second extension arm 140, and the trigger finger 222 (of the rotary trigger 198) and the mouth 212 (of the rotary hook 194) are shown extending outside of the rotary latch housing assembled from the rotary bottom housing 190 and the rotary top housing 192. The trigger leg 122 of the trigger arm 82 is aligned to push on the trigger finger 222 of the rotary trigger 198. The turned down pull tab 138 of the cam arm 84 will ride against a side of the activation leg 126 of the trigger arm 82.

Figure 4:
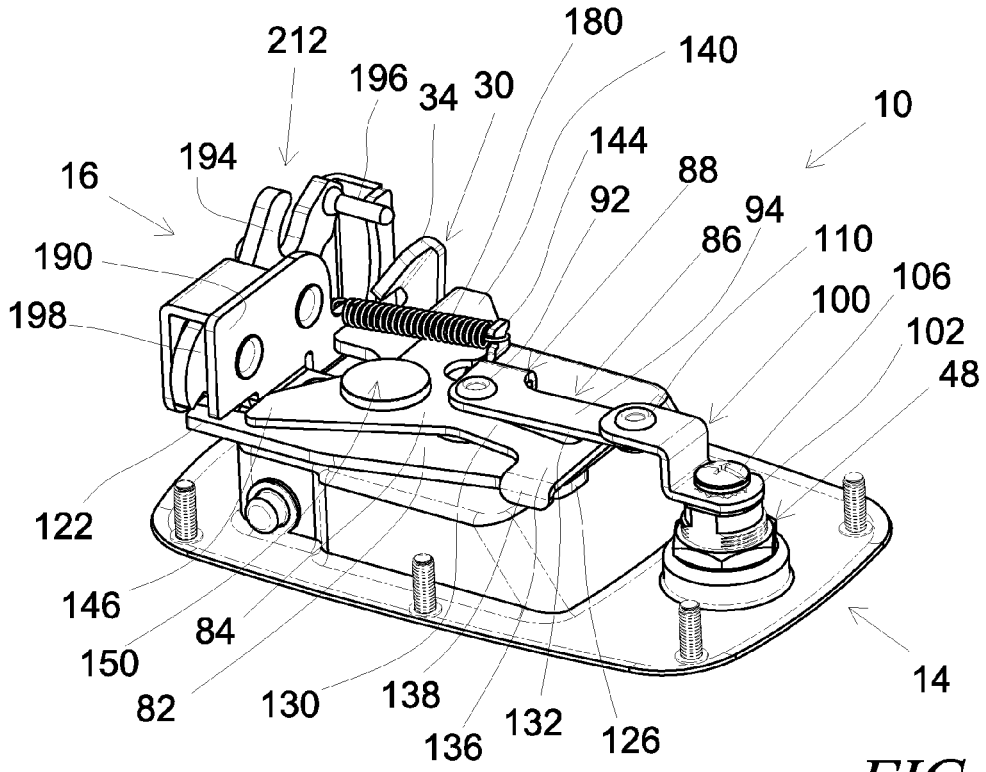
FIG. 4 is a rear top isometric view of the paddle latch of the invention in its key locked, rotary latch open, paddle handle down state.
Figure 5:
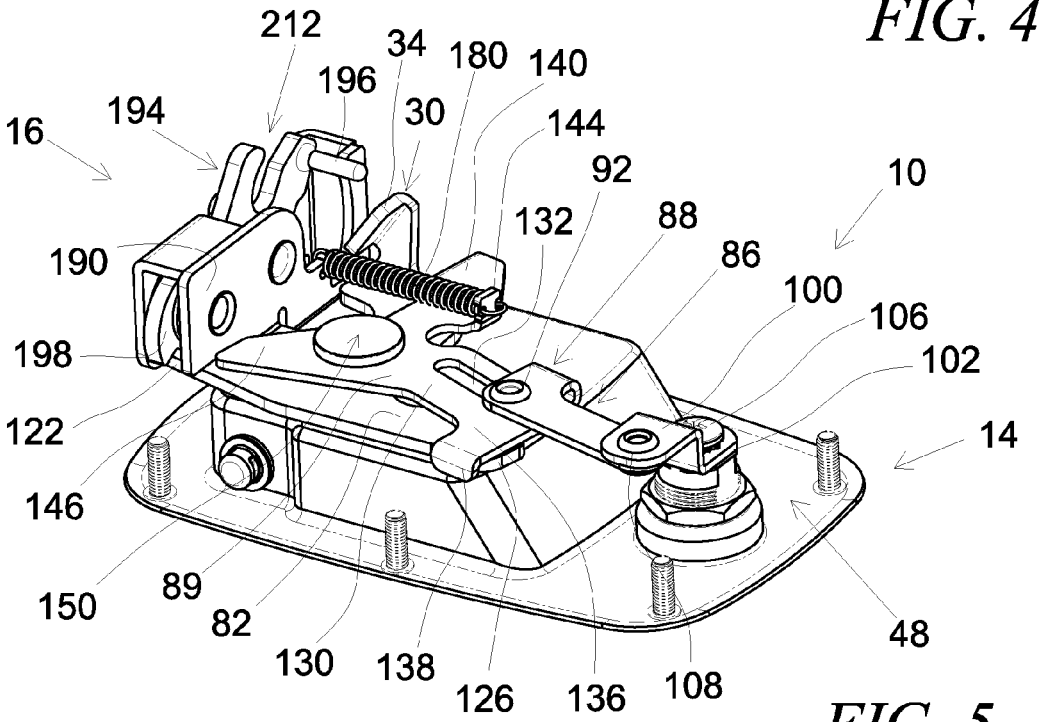
FIG. 5 is a rear top isometric view of the paddle latch of the invention in its key unlocked, rotary latch open, paddle handle down state.

FIG. 4 is a rear top isometric view of the exemplary paddle latch 10 in its key locked, rotary latch open, paddle handle down state, and FIG. 5 is a rear top isometric view of the paddle latch 10 in its key unlocked, rotary latch open, paddle handle down state. As can be seen, in FIG. 4, the linkage arm rivet 92 passes through the elongate slot 132 in the generally planar body 130 of the cam arm 84. The lock cam 100 connected at its first non-round end 102 by screw 106 to the key lock 48, and its other end 108 connects by lock cam rivet 110 to the cam arm 94 of the linkage arm 82. The bent over end 88 of the linkage arm 82 slideably extends around the trigger arm 82. The turned down pull tab 138 will ride on the activation leg 126 of the trigger arm 82. The trigger arm 82 and cam arm 84 are pivotally connected to the pan 14 by the trigger arm arrangement rivet 150. In FIG. 4, the spring 180 connects between the rotary latch 16 and the spring retainer 144 of the cam arm 84 is relatively unstretched, and the turned down push tab 142 of the second extension arm 140 bears against a side of the pin trigger 30. The bend over slanted surface 34 of the pin trigger 30 is show aligned with the pin 196 on the rotary hook 194 of the rotary latch 16. As can be seen, the mouth 212 of the rotary hook 194 is directly upwardly. This is the orientation of the rotary latch 16 before it has engaged with a bar of a catch (not shown) that will be positioned on a door frame, etc. (also not shown.) Also as shown in FIG. 4, the stop leg 146 of the trigger arm 82 is spaced away from the rotary latch 16. Also, the trigger leg 122 of the trigger arm 82 will be spaced away from the trigger finger 222 (not shown) of the rotary trigger 198, thereby not yet moving the rotary trigger 198 to allow the rotary hook 194 from rotating to close its mouth 212 relative to the housing 190 and 192 of the rotary latch 16. In FIG. 5, the key lock 48 is in its unlocked state. In this state, the lock cam 102 is spun by around 90 degrees, thereby pulling the bent over end 88 of the linkage arm 82 away from the trigger arm arrangement rivet 150 and towards the turned down pull tab 138. When this happens, the bent over end 88 will bear on an edge of the first extension arm 136 of the trigger arm 82 and cause it to rotate slightly from its position shown in FIG. 4 to its position shown in FIG. 5. This also causes the stop leg 146 of the trigger arm 82 to move slightly inwardly into the rotary latch 16 and close into contact with the trigger finger 222 (not shown) of the rotary trigger 198. In the states of the paddle latch of FIGS. 4 and 5, the rotary hook 194 of the paddle latch 10 has not be in contact with a catch on a door frame (not shown) so the door (not shown) carrying the paddle latch will remain opened, which will be obvious to users.

Figure 6:
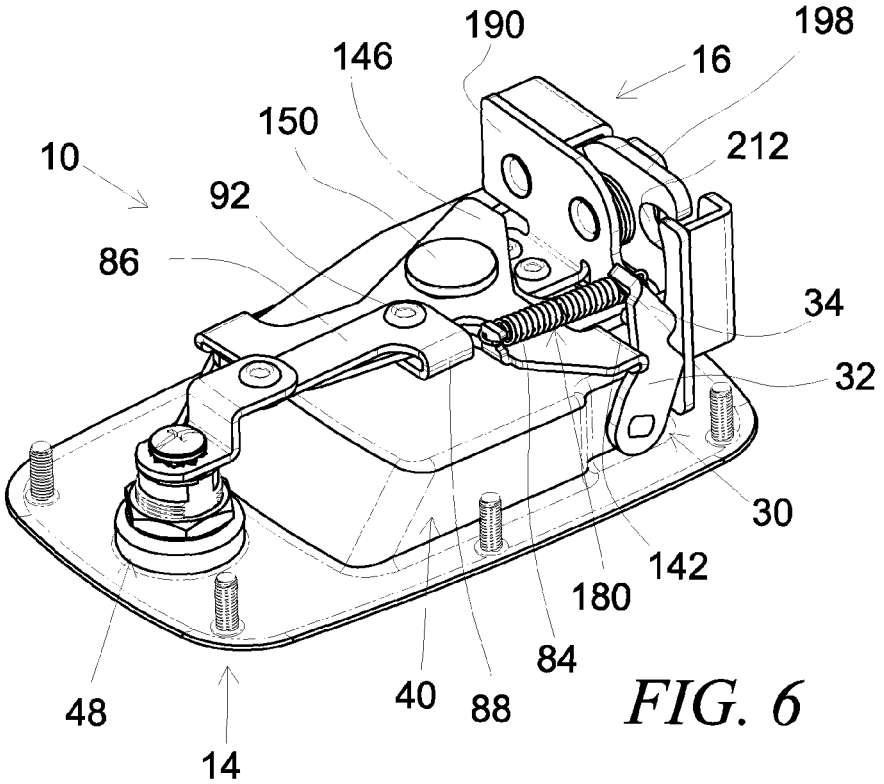
FIG. 6 is a rear bottom isometric view of the paddle latch of the invention in its key locked, rotary latch fully closed, paddle handle down state.
Figure 7:
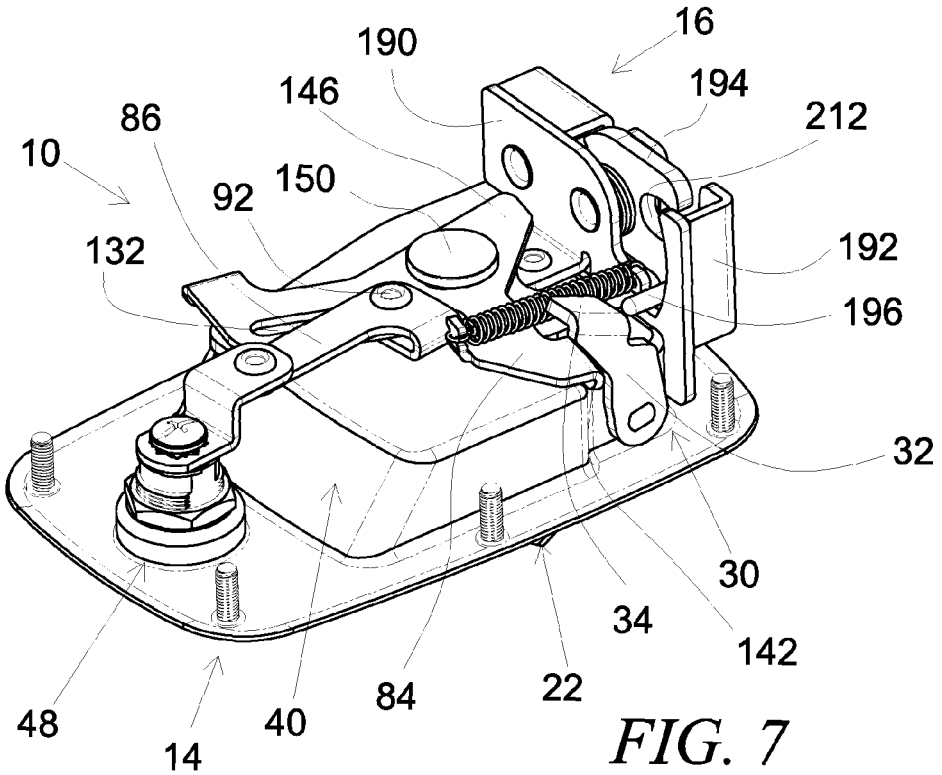
FIG. 7 is a rear bottom isometric view of the paddle latch of the invention in its key locked, rotary latch fully closed, paddle handle fully raised state.
Figure 6A:
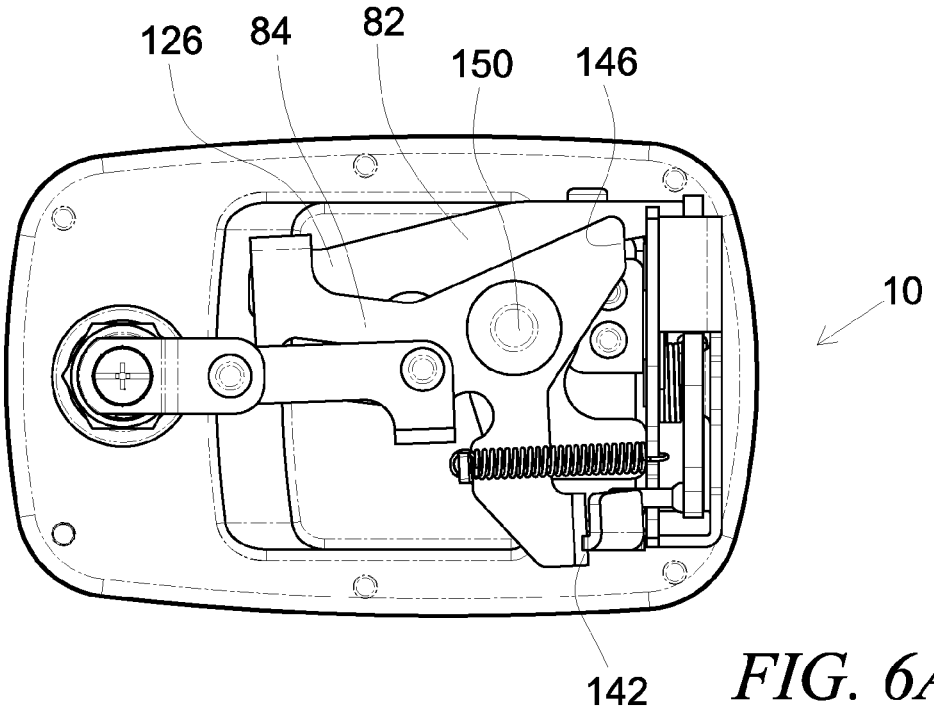
FIG. 6A is a rear view of the paddle latch in its state of FIG. 6.
Figure 7A:
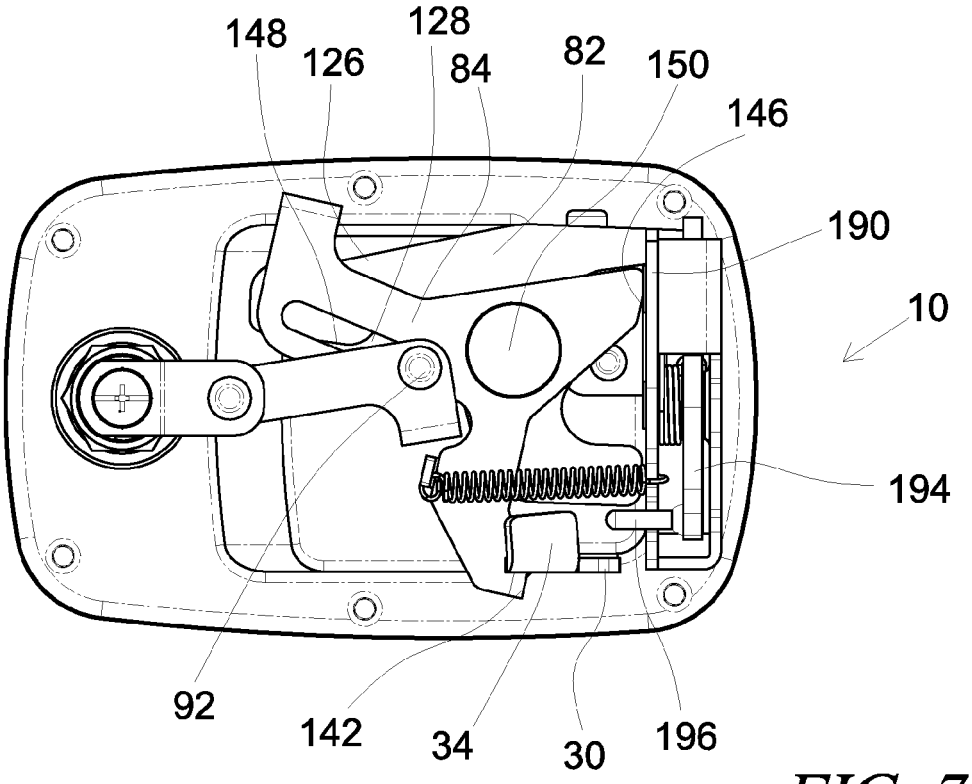
FIG. 7A is a rear view of the paddle latch in its state of FIG. 7.
Figure 6B:
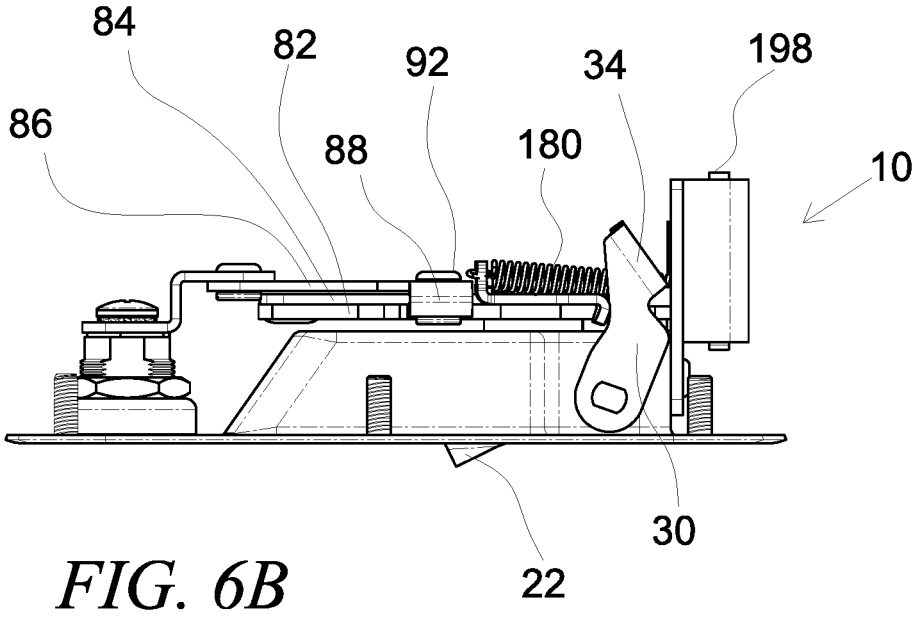
FIG. 6B is a bottom view of the paddle latch in its state of FIG. 6.
Figure 6C:
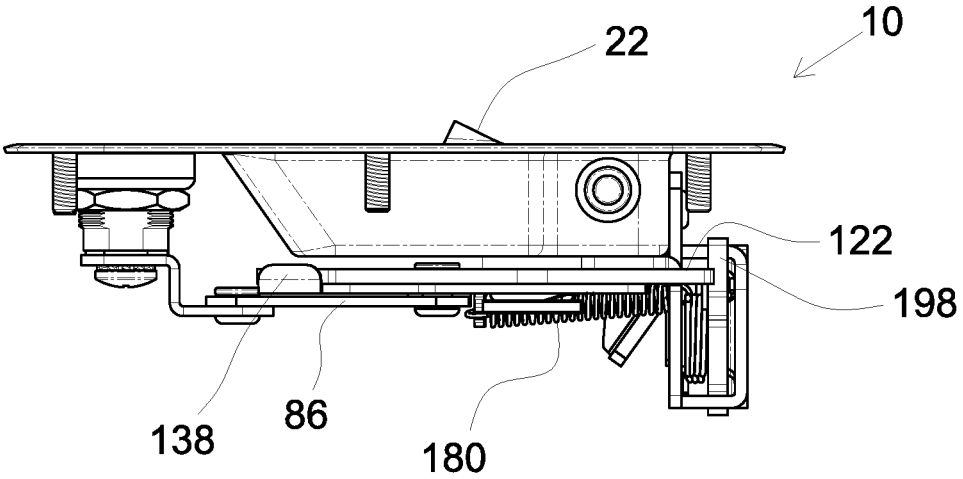
FIG. 6C is a top view of the paddle latch in its state of FIG. 6.
Figure 7B:
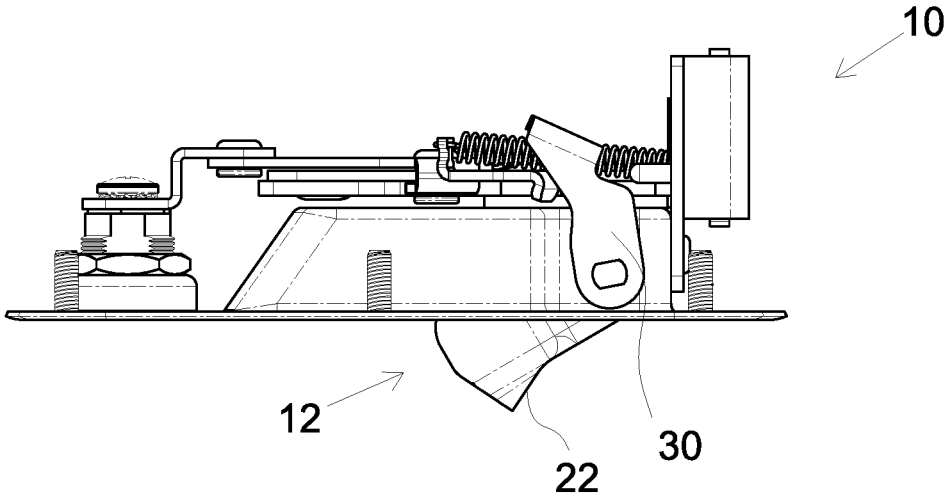
FIG. 7B is a bottom view of the paddle latch in its state of FIG. 7.
Figure 7C:
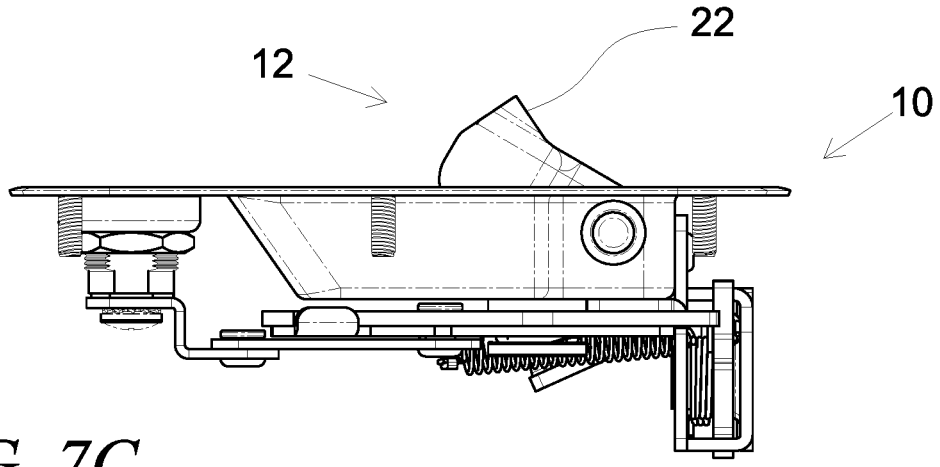
FIG. 7C is a top view of the paddle latch in its state of FIG. 7.

FIG. 6 is a rear bottom isometric view and FIG. 6A is a rear view of the paddle latch 10 in its key locked, rotary latch fully closed, paddle handle down state. FIG. 6B and FIG. 6C are a bottom view and a top view, respectively, of the paddle latch 10 in its key locked, rotary latch closed, paddle handle down state. FIG. 7 is a rear bottom isometric view and FIG. 7A is a rear view of the paddle latch 10 in its key locked, rotary latch closed, paddle handle fully raised state. FIG. 7B and FIG. 7C are a bottom view and a top view, respectively, of the paddle latch 10 in its key locked, rotary latch closed, paddle fully raised state. In FIGS. 6 and 7, the paddle latch 10 is in a similar state as shown in FIGS. 4 and 5, respectively, except that in FIGS. 6 and 6A and FIGS. 7 and 7A, the rotary latch 16 is in its locked position, wherein the rotary hook 194 is rotated down so that its mouth 212 is captured in the housing 190 and 192, and the pin 196 on the rotary hook 194 is in a lowered position in the housing 190 and 192. In FIGS. 6, 6A and 6B, the paddle handle (not shown) has not been moved from its resting position where it seats fully in the well 40 of the pan 14. FIGS. 7, 7A, and 7B, the grip portion 22 of the paddle handle is fully lifted out the pan 14. This causes the pin trigger 30 of the handle pivot 24 to rotate such that it will bear on the turned down push tab 142 of the cam arm 84, rotating the cam arm 84 clockwise on the trigger arm arrangement rivet 150 until its stop leg 146 impacts the housing 190, preventing the cam arm 84, the handle pivot 24, and the paddle handle 12 from rotating any further. As can be seen, when the key lock 48 is in its locked position, movement of the paddle handle 12 will not cause the trigger arm 82 to rotate sufficiently such that its trigger leg 122 can trip the rotary trigger 198 (not shown) in the rotary latch 16. As best shown in FIG. 7A, when the paddle handle is lifted, the pin trigger 30 will cause the cam art 84 to rotate. However, since the linkage arm rivet 92 will be in the elongate slot 132 closer to the trigger arm arrangement rivet 150 and in the vicinity of the relief area 128 of the activation leg 126 and away from the protrusion area 148 of the activation leg 126 of the trigger arm 82, rotation of the cam arm 84 will not cause the linkage arm rivet 92 to bear on the trigger arm 82.

Figure 8:
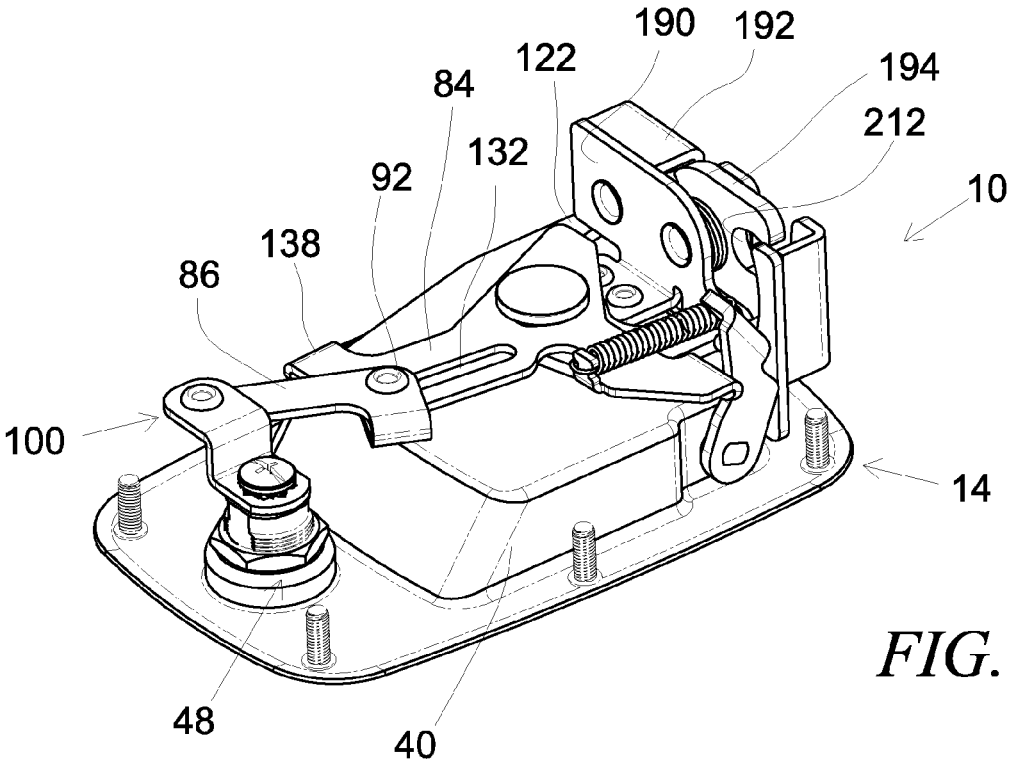
FIG. 8 is a rear bottom isometric view of the paddle latch of the invention in its key unlocked, rotary latch fully closed, paddle handle down state.
Figure 9:
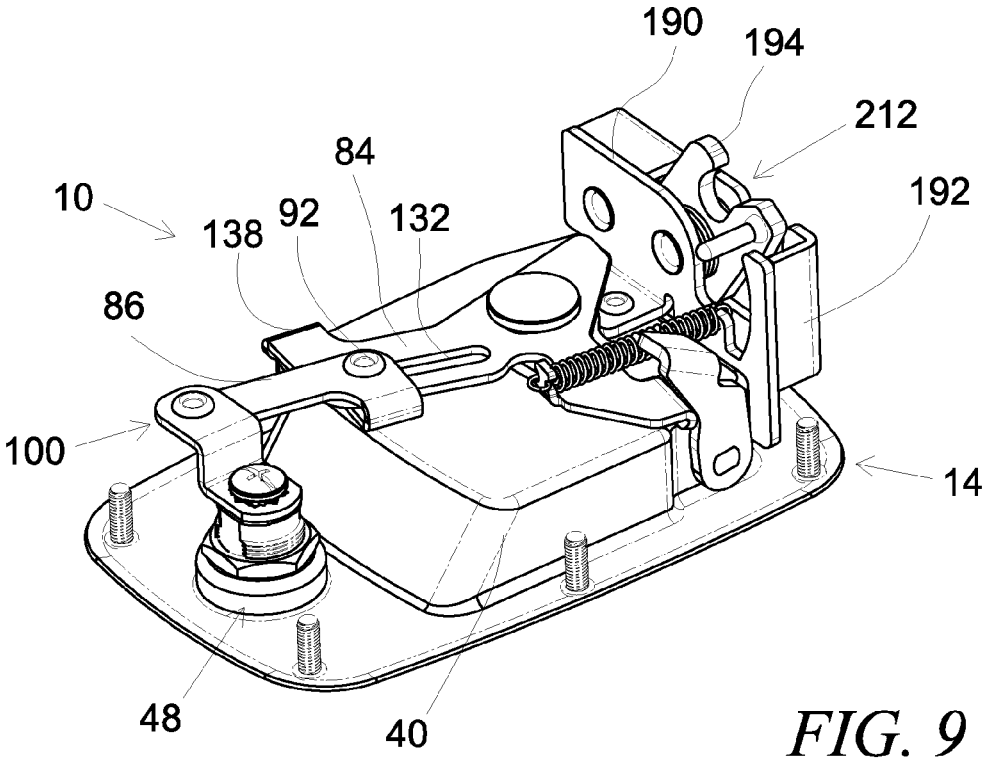
FIG. 9 is a rear bottom isometric view of the paddle latch of the invention in its key unlocked, rotary latch open, paddle handle fully raised state.
Figure 8A:
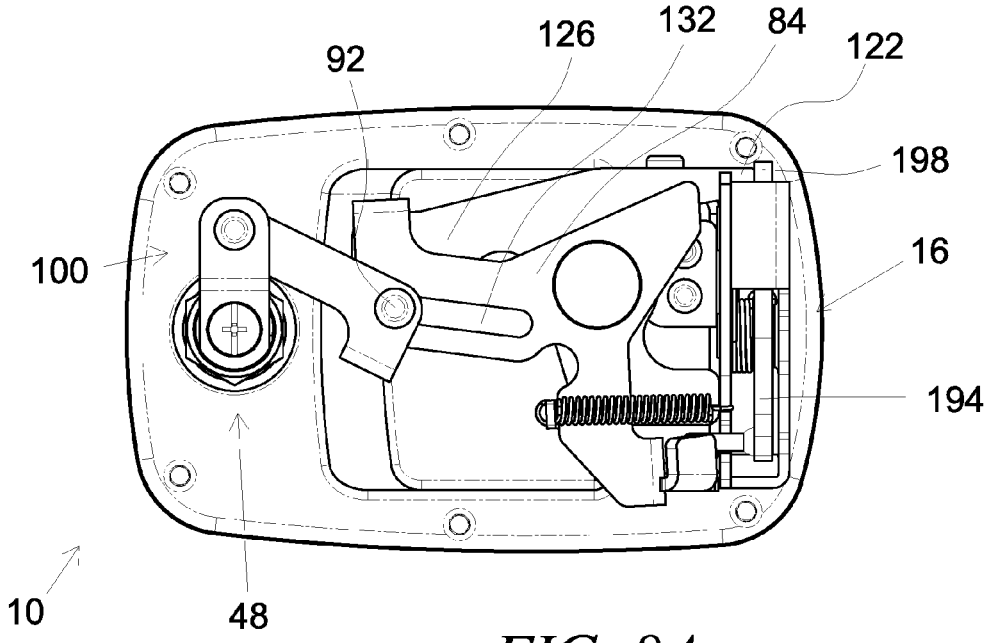
FIG. 8A is a rear view of the paddle latch in its state of FIG. 8.
Figure 9A:
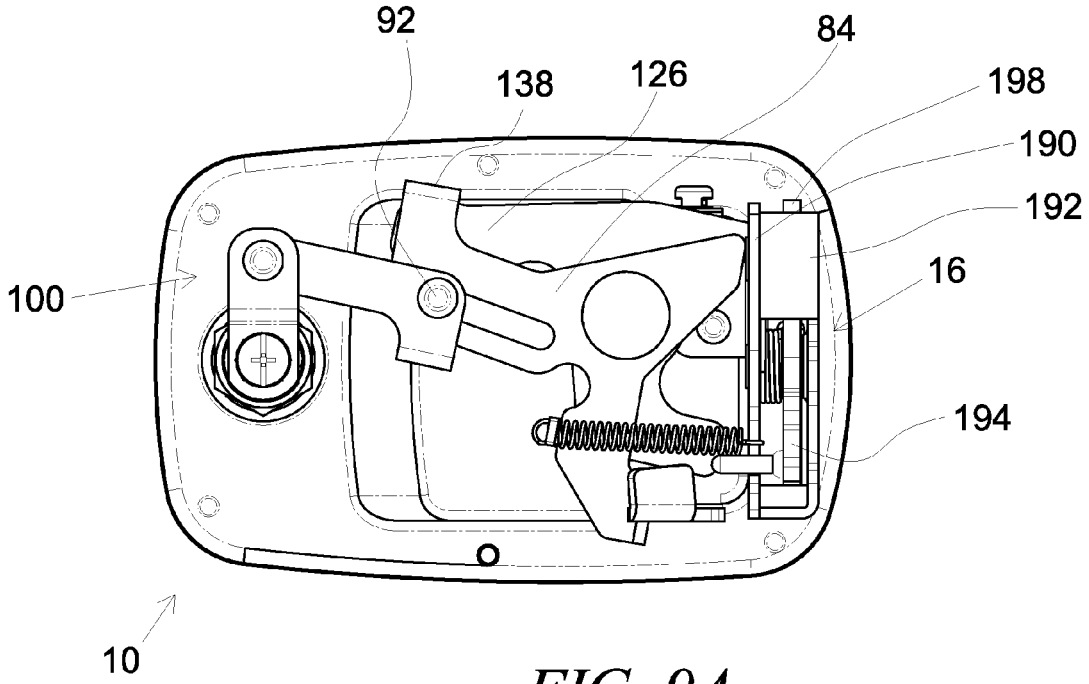
FIG. 9A is a rear view of the paddle latch in its state of FIG. 9.
Figure 8B:
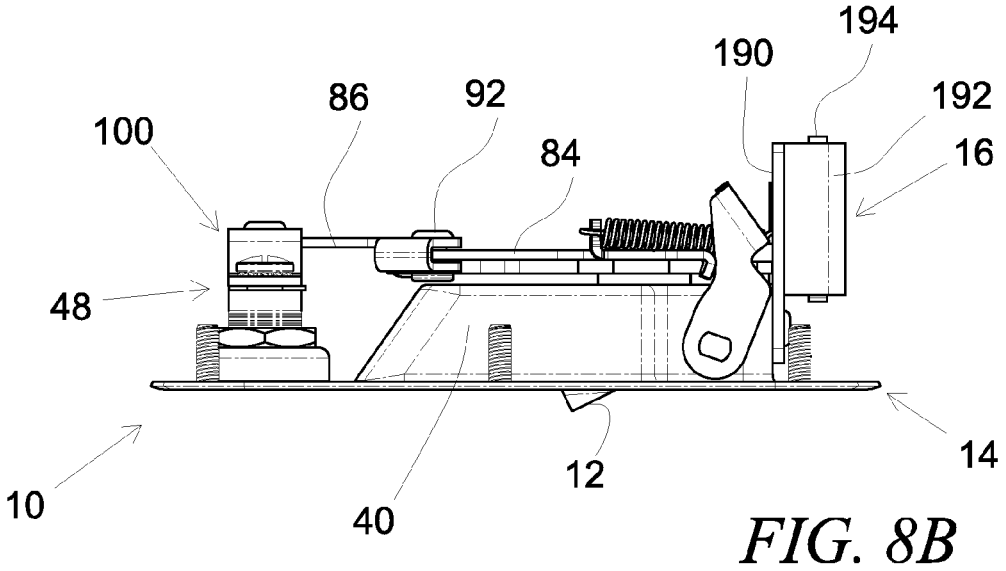
FIG. 8B is a bottom view of the paddle latch in its state of FIG. 8.
Figure 8C:
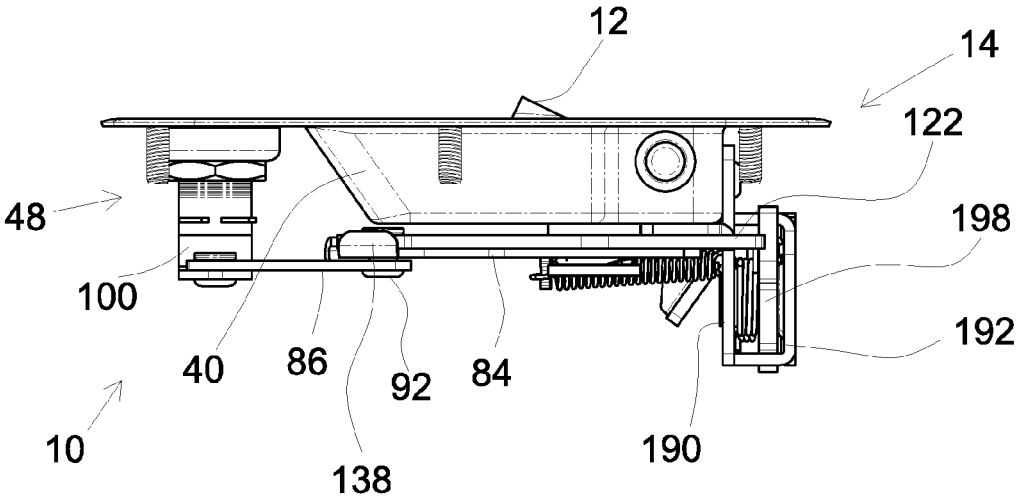
FIG. 8C is a top view of the paddle latch in its state of FIG. 8.
Figure 9B:
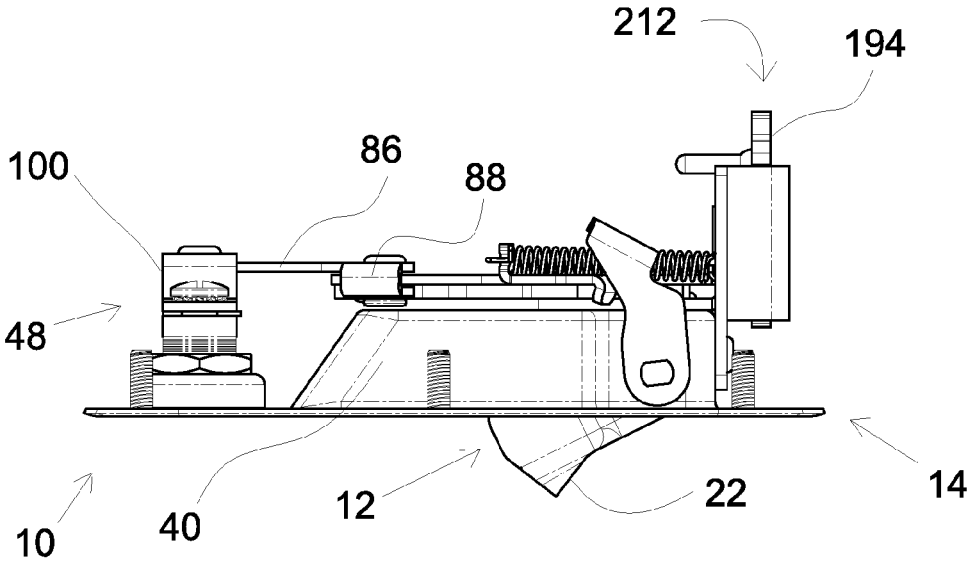
FIG. 9B is a bottom view of the paddle latch in its state of FIG. 9.
Figure 9C:
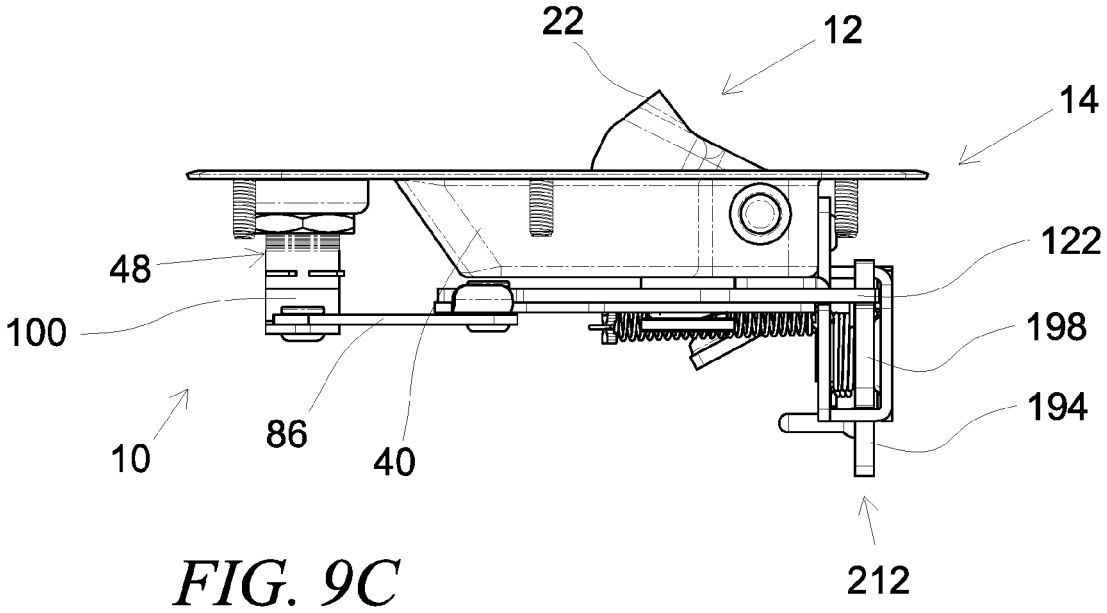
FIG. 9C is a top view of the paddle latch in its state of FIG. 9.

FIG. 8 is a rear bottom isometric view and FIG. 8A is a rear view of the paddle latch 10 in its key unlocked, rotary latch fully closed, paddle handle down state. FIG. 8B is a bottom view and FIG. 8C is a top view of the paddle latch 10 of FIG. 8 in its key unlocked, rotary latch closed, paddle handle down state. FIG. 9 is a rear bottom isometric view and FIG. 9A is a rear view of the paddle latch 10 in its key unlocked, rotary latch open, paddle handle fully raised state. FIG. 9B is a bottom view and FIG. 9C is a top view of the paddle latch 10 of FIG. 9 in its key unlocked, rotary latch open, paddle handle fully raised state. FIGS. 8, 8A, 8B, and 8C show the paddle latch 10 in a state similar to that shown in FIGS. 6 and 6A except that the key lock 48 is moved to its open position, causing the lock cam 100 to turn, pulling the linkage arm 86 and the linkage arm rivet 92 to move to a distant end of the elongate slot 132. In this position, the linkage arm rivet 92 will be bear next to the protrusion area 148 (not shown) of the activation leg 126 of the trigger arm 82. When a user lifts the paddle handle (not shown) to bring the paddle latch 10 to the state shown in FIGS. 9, 9A, 9B, and 9C, the activation leg 126 of the trigger arm 82 will thus be captured by the linkage arm rivet 92 on one side, and by the turned down pull tab 138 of the cam arm 84. Thus, movement of the paddle handle will rotate the trigger arm 82 and cause its trigger leg 122 to trip the rotary trigger 198 and release the rotary hook 194 so that its mouth 212 will face up. As best shown in FIGS. 8B and 8C, when the rotary hook 194 is fully closed so that its mouth 212 is captured in the housing 190 and 192, the paddle handle 12 will remain in its down position in the well 40 of the pan 14. One feature of the paddle latch 10 is to provide a visual indication to let users know when a door carrying the paddle handle 10 is not completed shut. For utility vehicles, the doors on the truck mounted cabinets often include rubber seals. These rubber seals have some push back which can require users to push the door closed to fully close the door.

Figure 12:
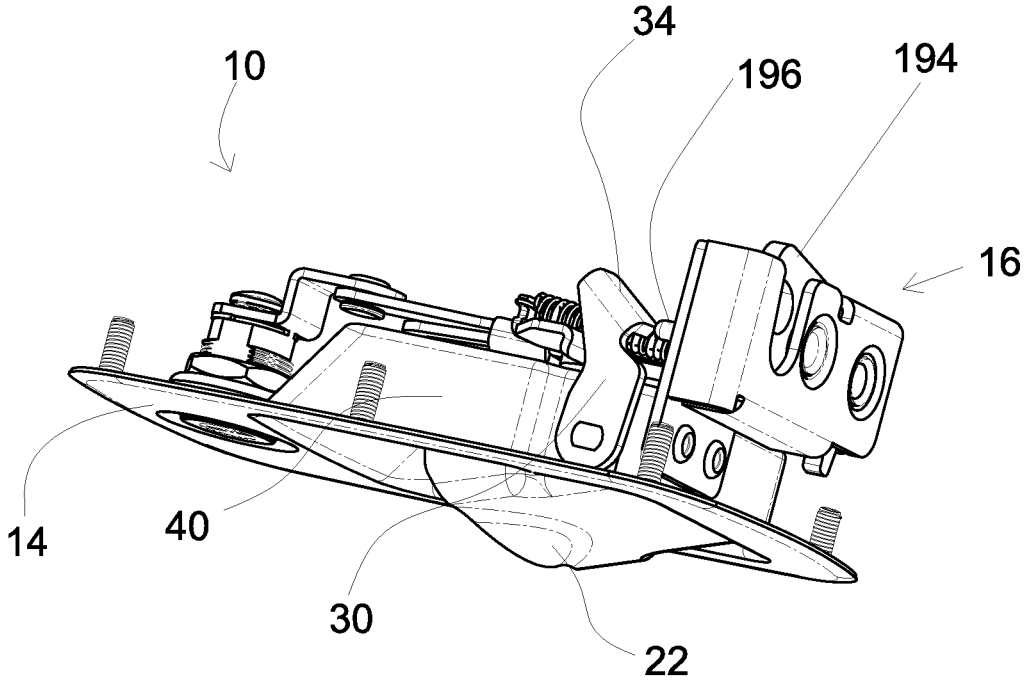
FIG. 12 is a front bottom isometric view showing the paddle latch in its key unlocked, rotary latch partially closed, paddle handle first raised state.

As best shown FIG. 12, when the rotary hook 194 is only partially closed, such as would be the case when a door is not completely closed, the pin 196 on the rotary hook 194 will continue to bear on a lower end of the bent over slanted surface 34 of the pin trigger 30, causing the pin trigger 30 to partially rotate the paddle handle so that it partially protrudes from the well 40 of the pan 14. Thus, users will have an easy to identify visual indication that a door is not completely closed. Internally inside the rotary latch 16, this state where the rotary hook 194 is only partially closed corresponds to a condition wherein the nose 224 of the rotary trigger 198 engages the first step 210A of the rotary hook 194, as opposed to a fully closed position of the rotary hook 194 when the nose 224 of the rotary trigger 198 engages the second step 210B of the rotary hook 194 (see FIG. 2, and FIGS. 10A and 10B).

Figure 10A:
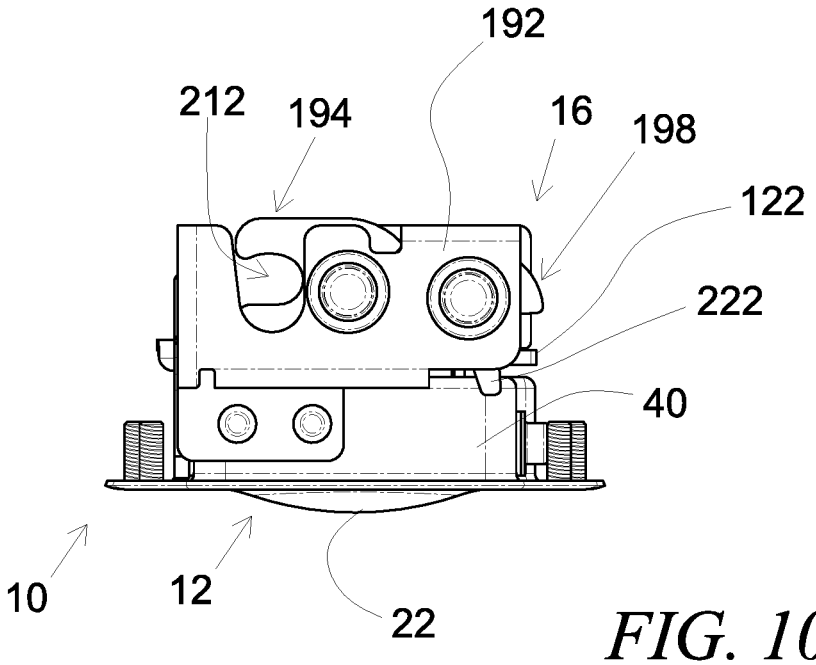
FIG. 10A is a left end view of the paddle latch in its key unlocked, rotary latch fully closed, paddle handle down state.
Figure 10B:
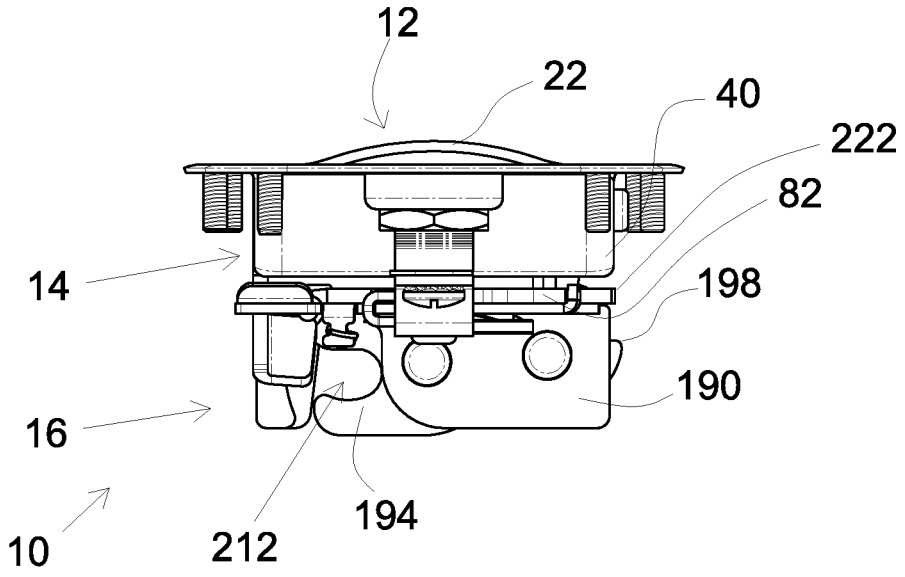
FIG. 10B is a right end view of the paddle latch in its key unlocked, rotary latch closed, paddle handle down state.

FIG. 10A is a left end view and FIG. 10B is a right end view of the paddle latch 10 of the invention in its key unlocked, rotary latch fully closed, paddle handle closed state. As can be seen the mouth 212 of the rotary hook 194 is rotated to that the mouth 212 is captured by the rotary top housing 192 and rotary bottom housing 190. The grip portion 22 of the paddle handle 12 is shown lying flat in the well 40 of the pan 14. The rotary trigger 198 and its trigger finger 222 are shown, as is the trigger leg 122 of the trigger arm 82.

Figure 11A:
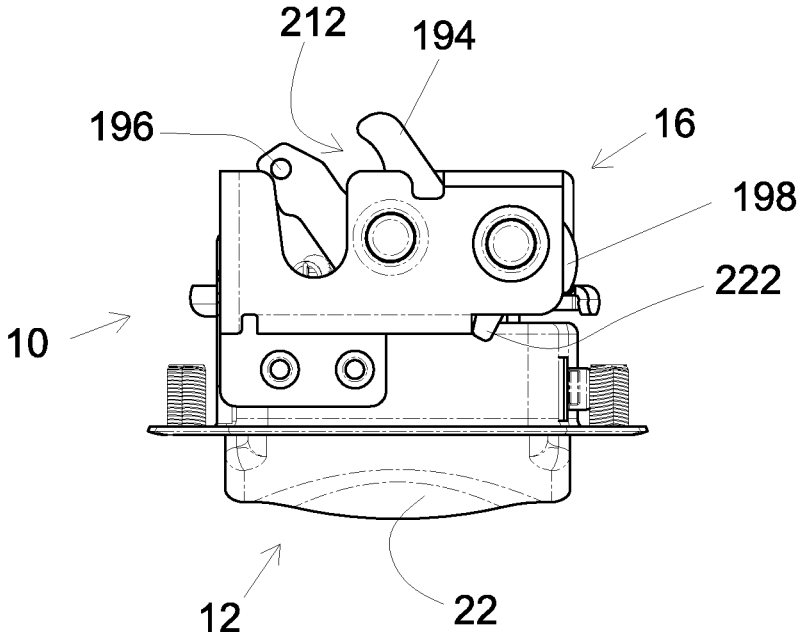
FIG. 11A is a left end view of the paddle latch in its key unlocked, rotary latch open, paddle handle fully raised state.
Figure 11B:
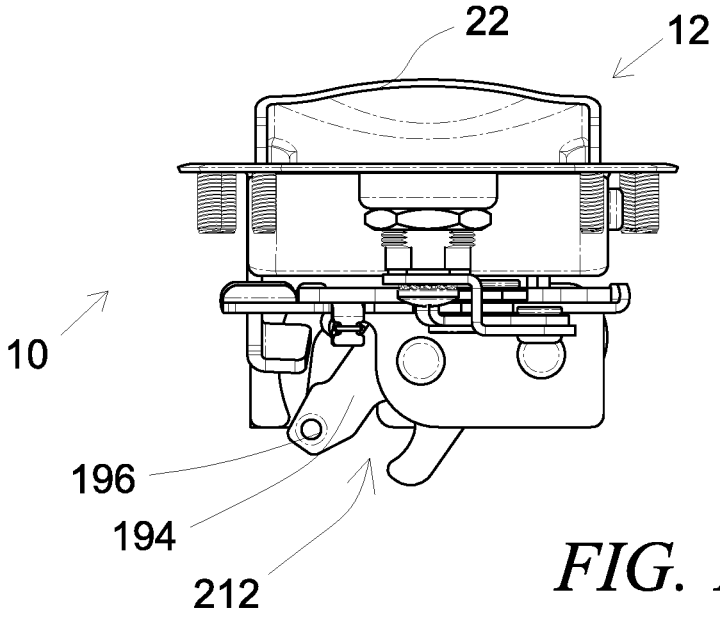
FIG. 11B is a right end of the paddle latch in its key unlocked, rotary latch open, paddle handle fully raised state.

FIG. 11A is a left end view and FIG. 11B is a right end of the paddle latch 10 of the invention in its key unlocked, rotary latch open, paddle handle second raised state. In this state, the paddle handle 12 is lift by its grip portion 22 so that the mouth 212 of the rotary hook 194 is accessible to receipt of a catch (not shown). As can also be seen, the trigger finger 222 of the rotary trigger 198 has released the rotary hook 194. The attachment of the pin 196 is also shown. In this position, the nose 224 of the rotary trigger 198 is not in engagement with either the first step 210A or the second step 210B of the rotary hook 194, as opposed to a fully closed position of the rotary hook 194 when the nose 224 of the rotary trigger 198 engages the second step 210B of the rotary hook 194 (see FIG. 2, and FIGS. 10A and 10B.)

Figure 13:
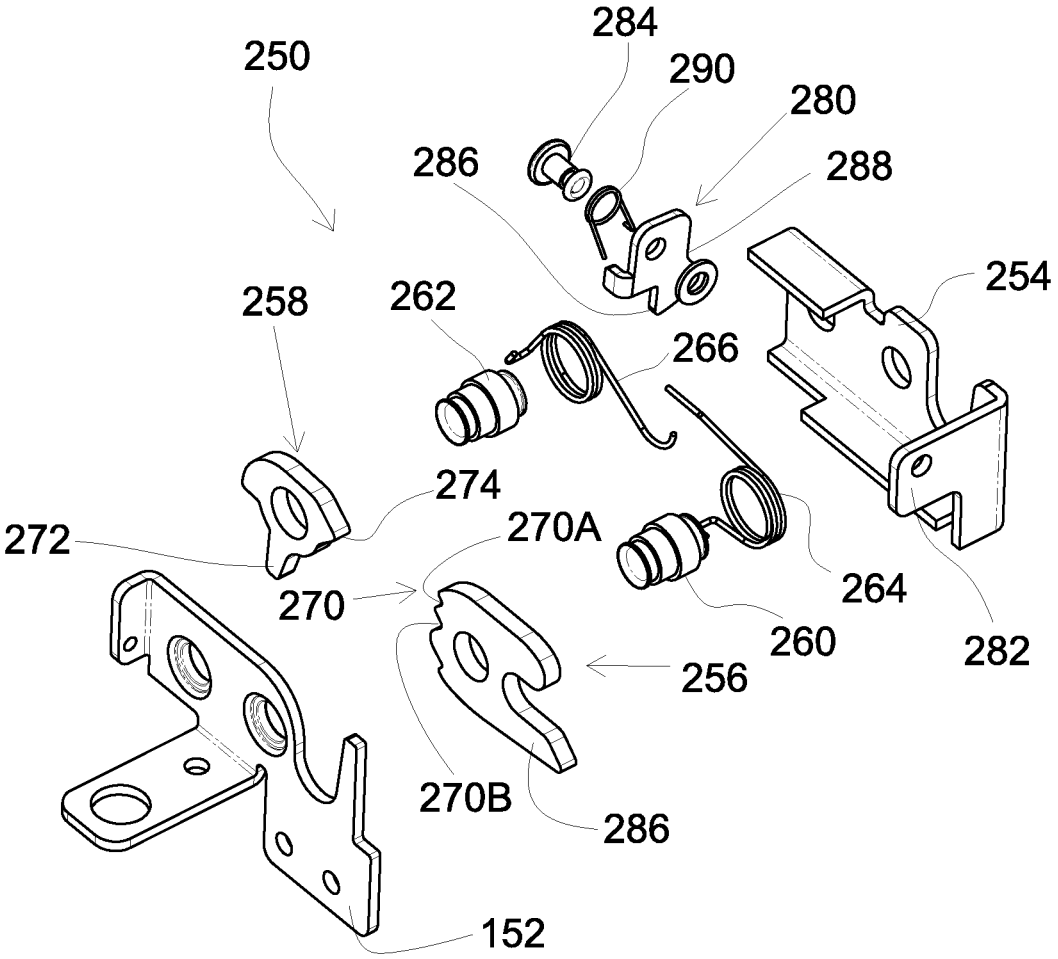
FIG. 13 is an exploded view showing another exemplary embodiment of a rotary latch portion of the paddle latch of the invention.
Figure 14:
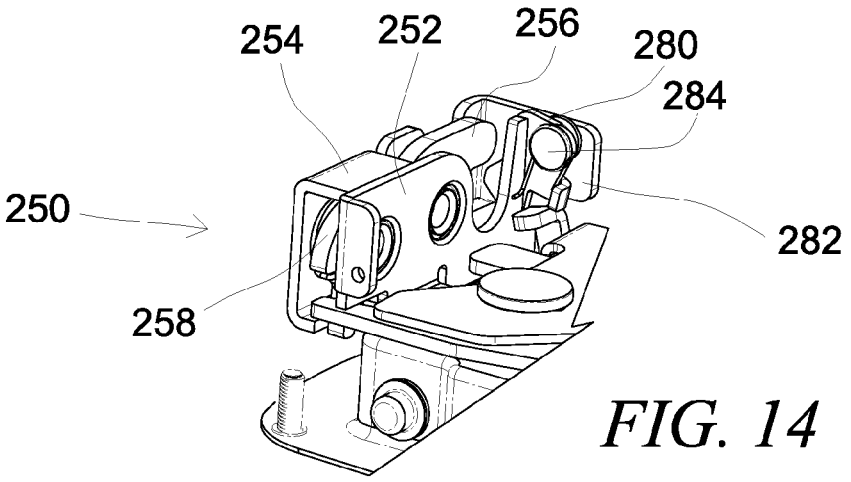
FIG. 14 is a rear top isometric assembled detail view showing the assembled rotary latch of FIG. 13.
Figure 15:
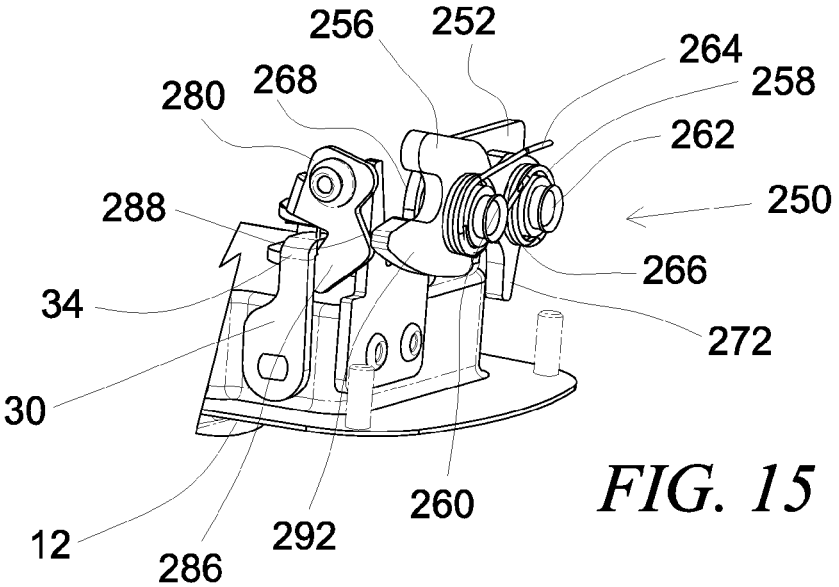
FIG. 15 is a rear bottom left end isometric detail view, with a rotary top housing removed, showing the rotary latch FIG. 14.
Figure 16:
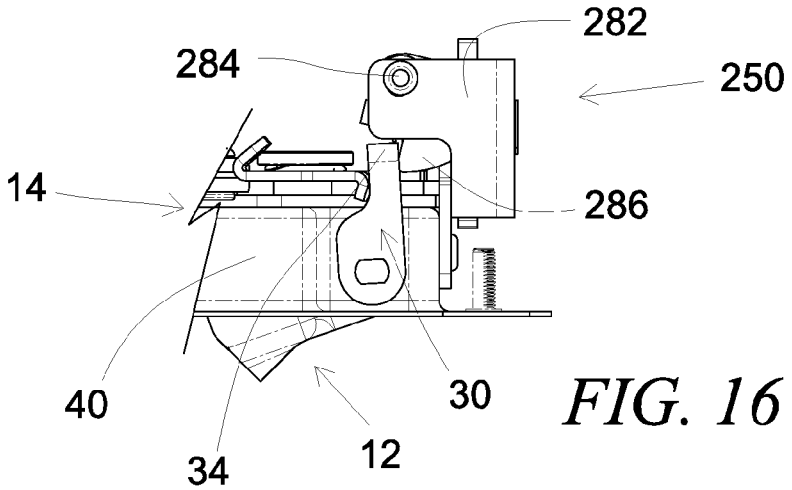
FIG. 16 is a bottom detail view, showing the rotary latch of FIG. 14.

FIGS. 13-16 show views of another exemplary embodiment of a rotary latch portion 250 of a paddle latch of the invention. FIG. 13 is an exploded view showing the parts of the rotary latch portion 250 thereof. FIG. 14 is a rear top isometric detail view, FIG. 15 is a rear left end isometric detail view, with a rotary top housing 254 removed, and FIG. 16 is a rear top isometric detail view thereof. Rotary latch 250 includes a rotary bottom housing 252, a rotary top housing 254. Located in the rotary bottom housing 252 and a rotary top housing 254 when they are assembled is a rotary hook 256, a rotary trigger 258, a rotary hook step spacer 260, a rotary trigger step spacer 262, and spring actuators 264 and 266 for asserting a rotational biasing force on the rotary hook 256 and the rotary trigger 258, respectively. The rotary hook 256 pivots on the rotary hook step spacer 260, and like the rotary latch 16 described above, has steps 270 formed on an end opposite a mouth 268 which is adapted to engage with a catch that will be mounted on a door frame (not shown). The rotary trigger 258 pivots on the rotary hook step spacer 262. The rotary trigger 258 has a trigger finger 272 at a lower end and a nose 274 that can engage with step 270 (first step 270A or second step 270B). Depending on which step, first step 270A or second step 270B, is engaged with the nose 274 of the rotary trigger 258, the position of the rotary hook 256 will be two different closed positions of the mouth 268. In the orientation as shown in FIG. 14, the mouth 268 is located entirely in the housing and the rotary hook 286 is completely closed. The spring actuators 264 and 266 tend to bias the rotary hook 256 and the rotary trigger 258, counter-clockwise and clockwise, respectively. In FIG. 15, the rotary hook 256 is rotated slightly upwardly and is a partially closed position. Unlike the rotary latch 16, the rotary latch 250 of FIGS. 13-16 includes a pin trigger cam 280, which pin trigger cam 280 is pivotally mounted on an inner surface of an extension wall 282, e.g., by a rivet 284. The pin trigger cam 280 has a nose 286 and a slanted edge 288. A biasing spring 290 will apply a biasing force on the pin trigger cam 280 to tend to push it into contact with an end 34 of the pin trigger 30 which connects to the paddle handle 12. The rotary hook 256 has a lower lip 292 which is aligned to make contact with the slanted edge 288 of the pin trigger cam 280 when the rotary hook 256 moves from its open position to a locked position, shown in FIG. 13. In the state shown in FIGS. 15 and 16, which corresponds to a state where the rotary hook 256 is not completely closed (e.g., it is in its first click position), the nose 286 of the pin trigger cam 280 will push on the end 34 of the pin trigger 30, which will cause the handle 12 to pop slightly out of the well 40 of the pan 14, thereby providing a visual indication that the rotary hook 256 is not completely locked. This visual indication will allow users to easily determine whether a door carrying the paddle latch 10 is completely closed, or as in the case of a latch in the state of FIGS. 15 and 16, is in fact not completely closed.

Figure 17:
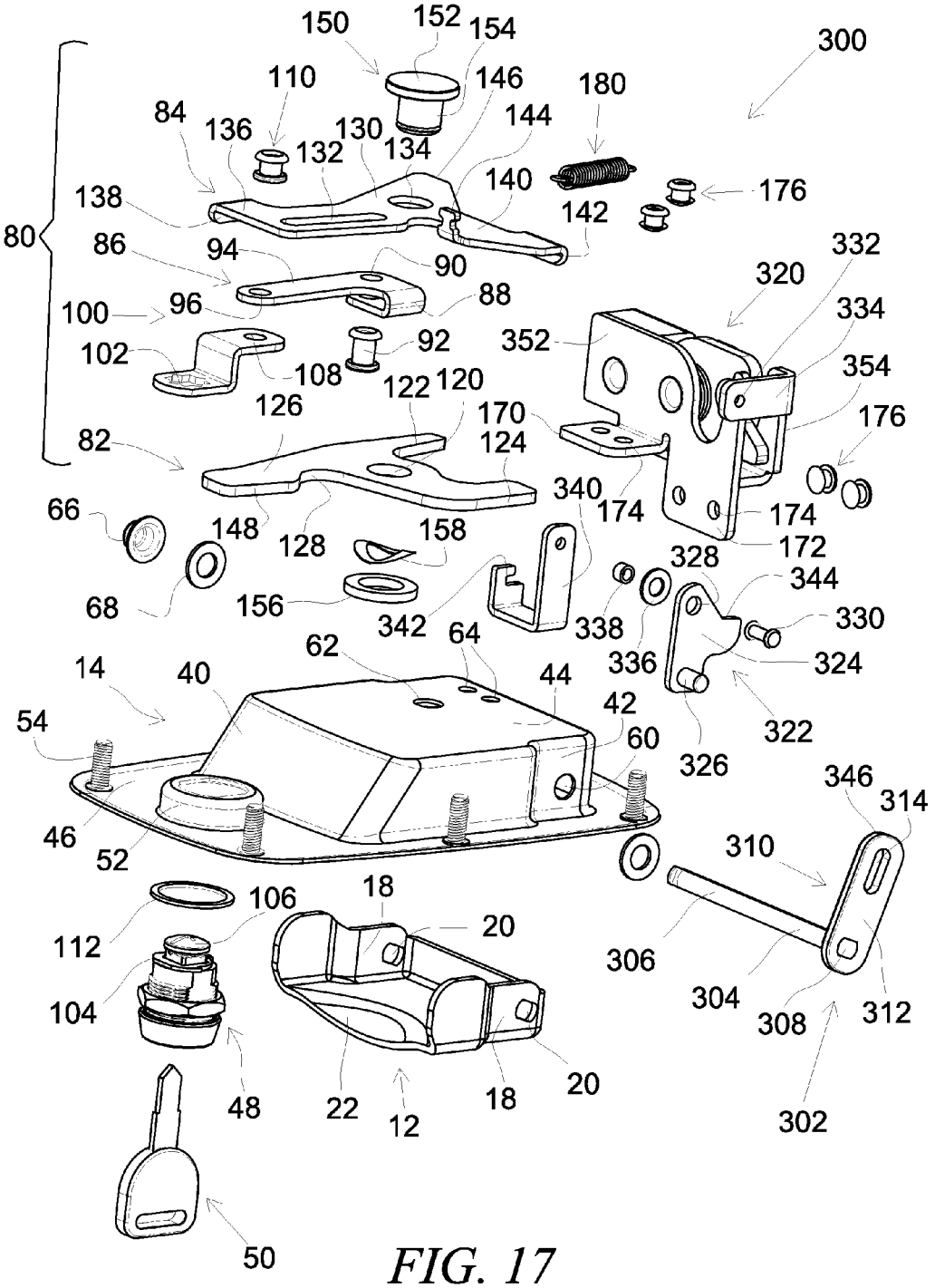
FIG. 17 is a rear bottom exploded view of another exemplary embodiment of a paddle latch of the invention.
Figure 18:
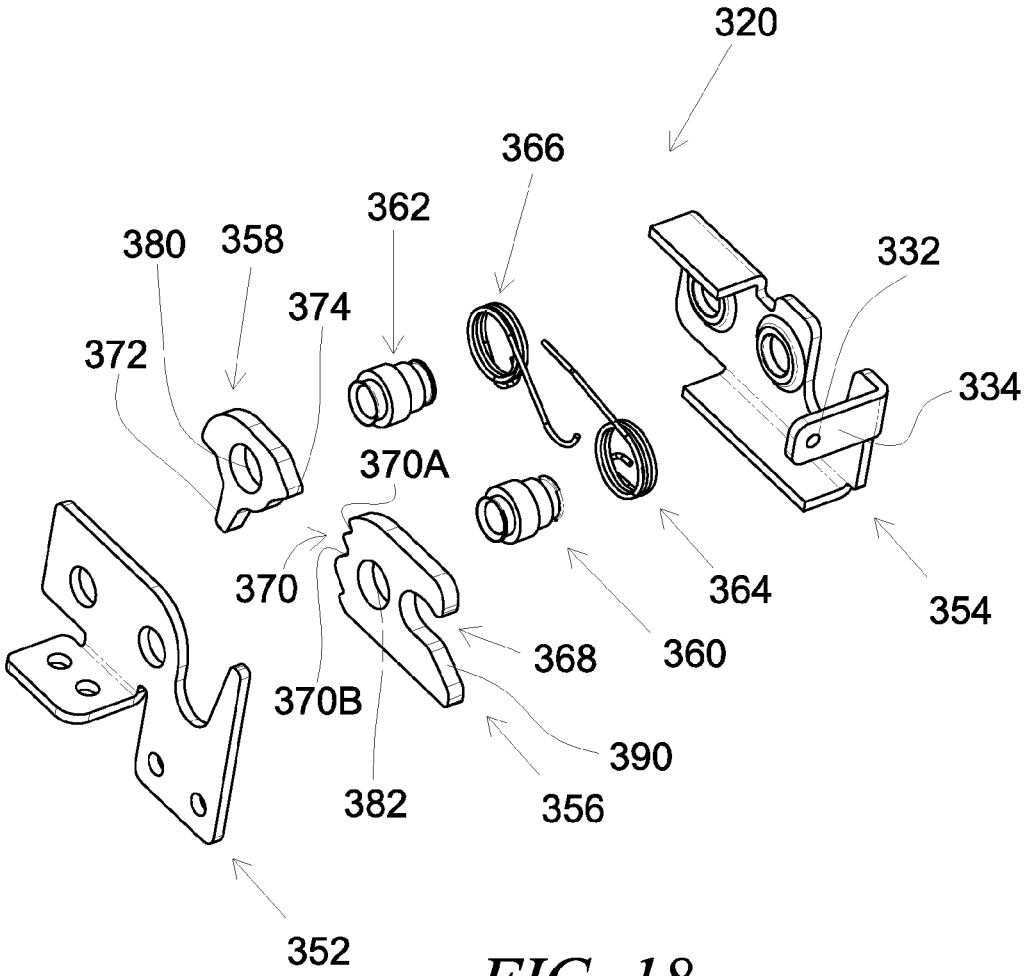
FIG. 18 is an exploded view of the exemplary rotary latch portion of the paddle latch of FIG. 17

FIG. 17 is a rear bottom exploded view of another exemplary embodiment of a paddle latch 300 of the invention and FIG. 18 is an exploded view of the exemplary rotary latch portion 320 of the paddle latch of FIG. 17. Except for the rotary latch portion 320 and some modifications to the paddle latch 300, the paddle latch is similar to the paddle latch 10 of FIGS. 1A, 1B and 2-12, and where applicable, the same reference numerals are used here to describe the same parts and their arrangement and operation.

Turning first to FIG. 17, the exemplary embodiment of a paddle latch 300 of the invention. Main components of the paddle latch include a paddle handle 12, a pan 14, and a rotary latch 320. The paddle handle 12 has sides 18 with non-round openings 20 formed therethrough. A grip portion 22 is located at an opposite end of the non-round openings. A handle pivot 302 is used to pivotally connect the paddle handle 12 to the pan 14. The handle pivot 302 has a non-round pin 304 with a free end 306. An opposite end of the pin 308 is fixed to a pin trigger 310. The pin trigger 310 can have a flat body portion 312 with an elongate slot 314 formed therein near a top 346 of the flat body portion 312. The pin trigger 310 can be a section of metal or plastic. The pan 14 has a well 40 formed therein, which is sized to receive the paddle handle 12. The well 40 has opposite parallel side wall section 42 and a bottom 44. A rim 46 extends around an upper end of the well 40. In versions of the paddle latch including a key lock 48 and key 50, a key cylinder opening 52 is formed in the rim 46. In order to provide attachment points of the paddle latch 10 to door or other item to which the paddle latch 10 will be affixed (not shown), threaded studs 54 can be provided. However, other types of devices could be used instead. Pin apertures 60 are formed in the side wall section 42 and are sized to slideably and rotatably receive the pin 304. Passing through the bottom 44 of the well 40 can be a rivet receiving hole 62 and rotary latch rivet holes 64. A pin cap 66 can be provided that is sized to engage with the free end 306 of the non-round pin 304. To help prevent the passage of liquid or other material from passing through the pin apertures 60 and into the well 40 of the pan 14, seal washers 68 are preferably provided to ride on an outside surface of the side wall section 42 of the well 40 and be sandwiched by the flat body portion 312 of the pin trigger 310 and the seal washers 68. The non-round pin 304 will be rotatably passed through the pin apertures 60 in the opposite parallel side wall sections 42 of the well 40, and non-rotatably pass through the non-round openings 20 formed in the handle 12. As thus assembled, pivoting of the handle 12 relative to the pan 14 causes the pin trigger 310 to rotate in concert with the handle 12. Pivotally attached to the bottom 44 of the well 40 is a trigger arm arrangement 80, made up of several components, include a trigger arm 82, a cam arm 84, and a linkage arm 86. The linkage arm 86 has a bent over end 88 with holes 90 that pass therethrough, which holes 90 receive a linkage arm rivet 92. An opposite end 94 of the linkage arm 86 has an attachment point 96, such as a through hole. The bent over end 88 has two spaced apart walls 98 and when the linkage arm rivet 92 is fitted into the holes 96, it will bridge the two spaced apart walls 98. The two spaced apart walls 98 are spaced apart a distance that is large enough to slideably receive the cam arm 84, as will be described further below. A lock cam 100 is provided, which has a first end with a non-round aperture 102 which is adapted to be fitted to a turning end 104 of the key lock 48, e.g., with a screw 106. When the key lock 48 is turned, the lock cam 100 will accordingly also turn. The lock cam 100 has a second end with an aperture 108. When the paddle handle 10 is assembled, a lock cam rivet 110 will pass through the attachment point (through hole) 96 in the linkage arm 86 and the aperture 108 in the lock cam 100, thereby pivotally connecting together the linkage arm 86 and the lock cam 100. A seal 112, such as a rubber washer or O-ring can be used to secure the key lock 48 in the key cylinder opening 52. Turning back to the trigger arm 82, it has a trigger arm pivot point, such as a round hole 120, a trigger leg 122, and a stop leg 124, and an activation leg 126, the purposes of which will be described in greater detail below. The activation leg 126 has a relief area 128 closer to the round hole 120 and a protrusion area 148 further away from the round hole 120. The trigger arm 82 is preferably flat, and can be made of strong material, such as steel. The cam arm 84 has generally planar body 130 with an elongate slot 132 formed therethrough. A cam arm pivot point, such as a round hole 134 is formed through the generally planar body 130. Extending next to the elongate slot 132 is the first extension arm 136 which has a turned down pull tab 138. Distant from the elongate slot 132 is a second extension arm 140 with a turned down push tab 142. A spring retainer 144, e.g., in the form of a turned up tab can be located on the second extension arm 140. The cam arm 84 also has a stop leg 146. When assembled, a trigger arm arrangement rivet 150 is used to pivotally retain the cam arm 84 over the linkage arm 86. The trigger arm arrangement rivet 150 has a generally flat head 152 and a cylindrical shaft 154. The cylindrical shaft 154 will pass through cam arm pivot round hole 134 and through the trigger arm pivot round hole 120 and be permanently secured in the rivet receiving hole 62 in the bottom 44 of the well 40. A bearing washer 156 and wave spring 158 can be placed between the bottom 44 of the well 40 and an underside surface of the trigger arm 82 to ensure smooth but wobble-free movement of the components. The rotary latch 320 has a rotary bottom housing 352 with bracket portions 170 and 172 with holes 174 that can be used to permanently fix the rotary latch 320 to the pan 14 using fixtures, such as rivets or screws 176. A return spring 180 hooks on between the rotary latch 320 and the spring retainer 144 of the cam arm 84 to bias the second extension arm 140 and its turned down push tab 142 towards the rotary latch 320. The rotary latch 320 connects to a pin trigger cam 322 which comprises a flat plate 324 with a pin 326 extending therefrom. A pivot hole 328 is formed in the flat plate 324. A rivet 330 is used to pivotally attach the pin trigger cam 322 through its pivot hole 328 to a hole 332 formed in wall section 334 of a rotary top housing 354 of the rotary latch 320. The pin trigger cam 322 has a slanted edge 344, the purpose of which is described below. A washer 336 and bearing 338 permit movement of the pin trigger cam 322 relative to the rotary. A bracket 340 can be provided to further support the pin trigger cam 322. The bracket 340 can be affixed to the bottom 44 of the pan 14, and can include a spring attachment point 342.

Figure 21:
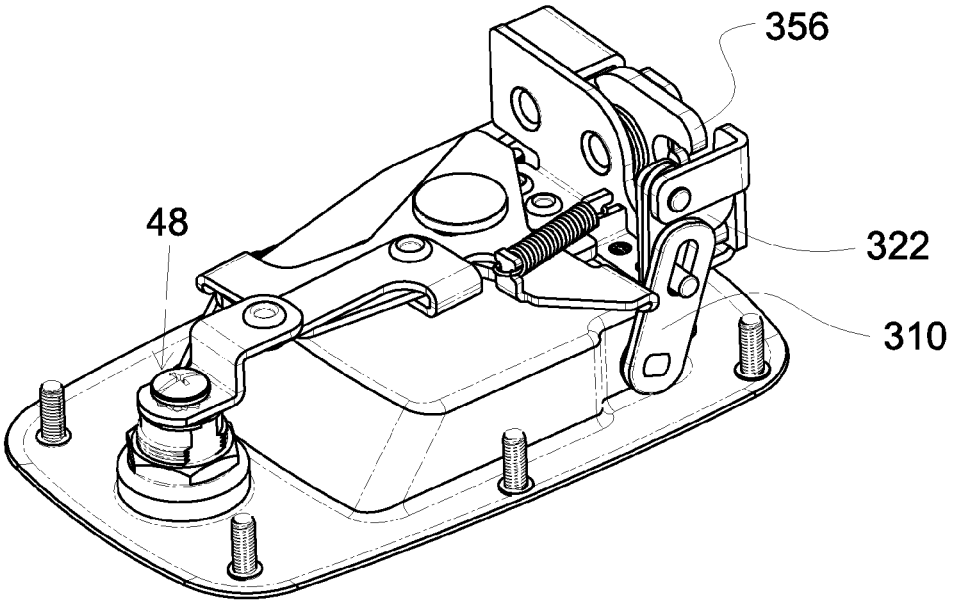
FIG. 21 is a rear bottom isometric view of the paddle latch of the invention in its key locked, rotary latch closed, paddle handle down state.
Figure 22:
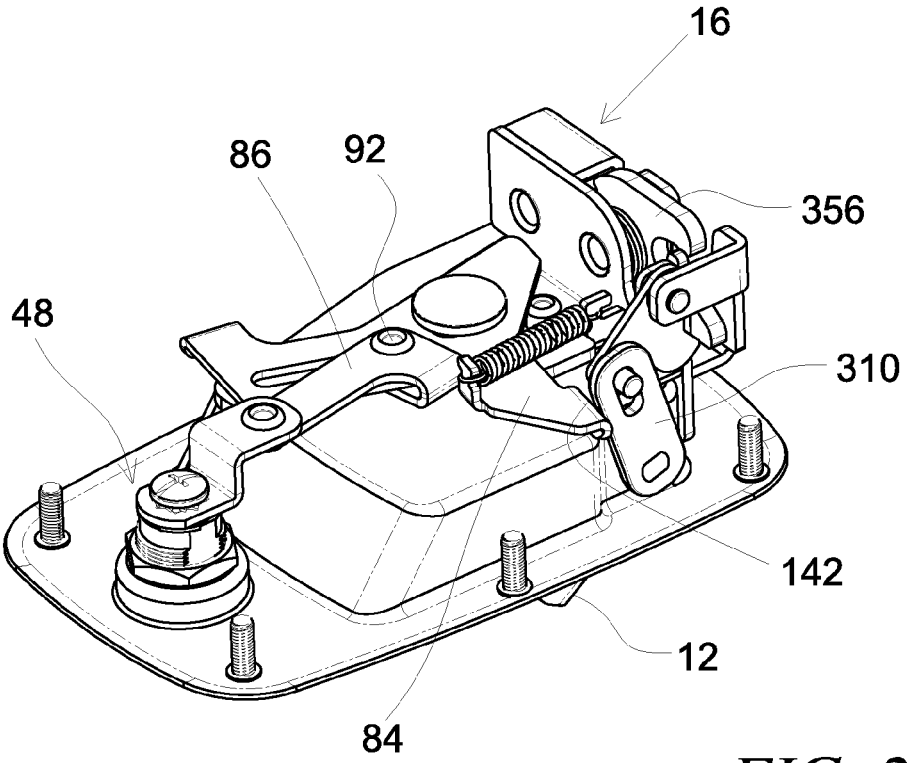
FIG. 22 is a rear bottom isometric view showing an assembled view of the paddle latch of FIG. 17 in its key locked, rotary latch completely closed, paddle handle fully raised state.

Turning now to FIG. 18, there is shown an exploded view of the exemplary rotary latch 320 of the paddle latch 300 of the invention. Rotary latch 320 includes a rotary bottom housing 352, a rotary top housing 354. Located in the rotary bottom housing 352 and a rotary top housing 354 when they are assembled is a rotary hook 356, a rotary trigger 358, a rotary hook step spacer 360, a rotary trigger step spacer 362, and spring actuators 364 and 366 for asserting a rotational biasing force on the rotary hook 356 and the rotary trigger 358, respectively. The rotary hook 356 pivots on the rotary hook step spacer 360, and like the rotary latch 250 described above, the rotary hook 356 has steps 370 formed on an end opposite a mouth 368 which is adapted to engage with a catch that will be mounted on a door frame (not shown). The rotary trigger 358 pivots on the rotary hook step spacer 362. The rotary trigger 358 has a trigger finger 372 at a lower end and a nose 374 that can engage with step 370 (first step 370A or second step 370B). Depending on which step, first step 370A or second step 370B, is engaged with the nose 374 of the rotary trigger 358, the position of the rotary hook 356 will be two different closed positions of the mouth 368. In the orientation as shown in FIGS. 21-23, the mouth 368 is located entirely in the housing and the rotary hook 356 is completely closed. Pivot holes 380 and 382 are formed in the rotary trigger 358 and rotary hook 356, respectively, on are positioned on the spacers 360 and 362. The spring actuators 364 and 366 tend to bias the rotary hook 356 and the rotary trigger 358, counter-clockwise and clockwise, respectively.

Figure 19:
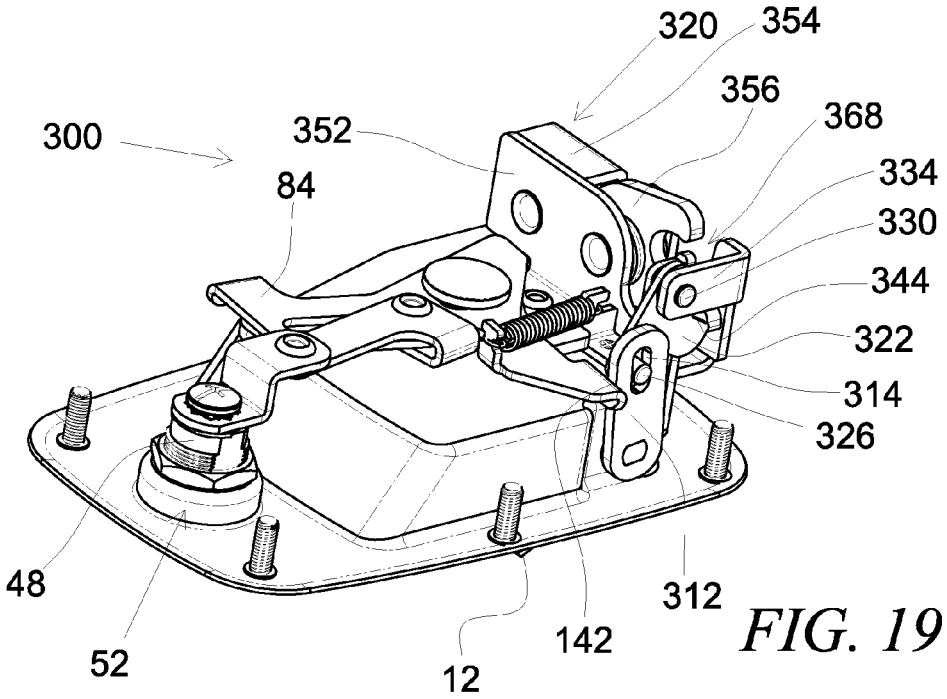
FIG. 19 is a rear bottom isometric view showing an assembled view of the paddle latch of FIG. 17 in its key locked, rotary latch partially closed, paddle handle fully raised state.
Figure 20:
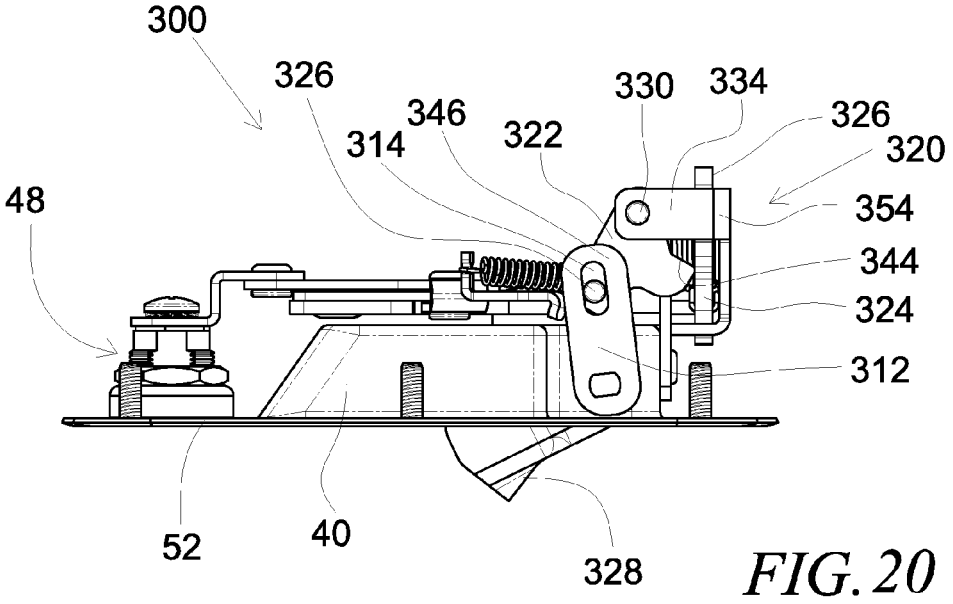
FIG. 20 is a bottom view showing the rotary latch of the paddle latch in its state of FIG. 19.

FIG. 19 is a rear bottom isometric view and FIG. 20 is a bottom view of the paddle latch 300 with the rotary latch 320 in a semi-closed state with a key lock 48 in its locked position. The rotary latch 320 is similar to the rotary latch 250 shown and described in FIGS. 13-16, except that it has a pin trigger cam 322 with an extending pin 326. The pin trigger cam 322 is pivotally mounted by a pivot 330 (e.g., a rivet) to the extension wall 334 of the rotary top housing 354. The pin trigger cam 322 has a slanted edge 344 which is designed to be moved by a lower lip 390 of the rotary hook 356 when the rotary hook 356 is partially closed, as shown in FIG. 19. As can be seen, the paddle handle 12 will partially extend outside of a well 40 of the pan 14. The extending pin 326 of the pin trigger cam 322 will be slideably retained in an elongate slot 314 formed in a distal end 346 of a pin trigger 302 that is connected to the paddle handle 12. As best shown in FIG. 19, the pin trigger cam 312 is slideably positioned between the extension wall 334 of the rotary top housing 354 and a bracket 340 that is fixed to the pan 14. This helps stabilize the motion of pin trigger cam 322. Other features of the paddle latch 300 are as described above with respect to the other embodiments of paddle latches and will not be described further.

FIG. 21 is a rear bottom isometric view of the paddle latch 300 in its key locked, rotary latch closed, paddle handle down state. As can be seen in this state, the rotary hook 356 is completely closed so that its mouth 368 will fully enclosed by the housing portions 352 and 354. In this position, the lower lip 390 of the rotary hook 356 clears the pin trigger cam 322 to that the pin trigger cam 322 and its pin 326 are moved back towards the rotary latch. This moves the pin trigger 310 clockwise so that the attached handle 12 will move back into the well 40 of the pan 14.

Figure 22A:
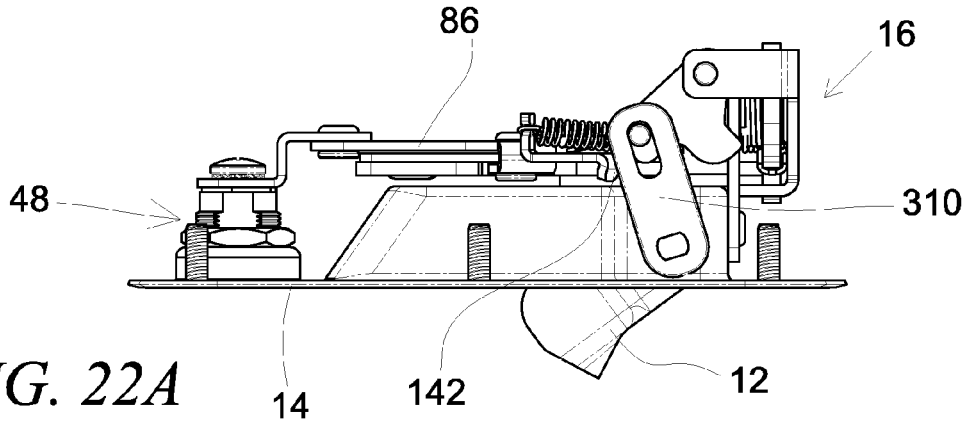
FIG. 22A is a bottom view showing the rotary latch of the paddle latch in its state of FIG. 22.

FIG. 22 is a rear bottom isometric view and FIG. 22A is a bottom view showing an assembled view of the paddle latch 300 in its key locked, rotary latch completely closed, paddle handle 12 in fully raised state. Since the key lock 48 is still locked, the rivet 92 in the end of the linkage arm 86 will not cause the rotary latch to be opened even as the handle 12 is lifted and the pin trigger 310 bears on the turned down push tab 14 of the cam arm 84.

Figure 23A:
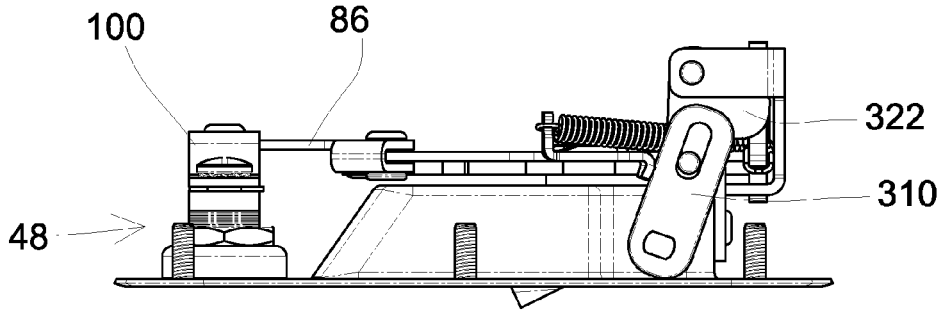
FIG. 23A is a bottom view showing the rotary latch of the paddle latch in its state of FIG. 19.
Figure 23:
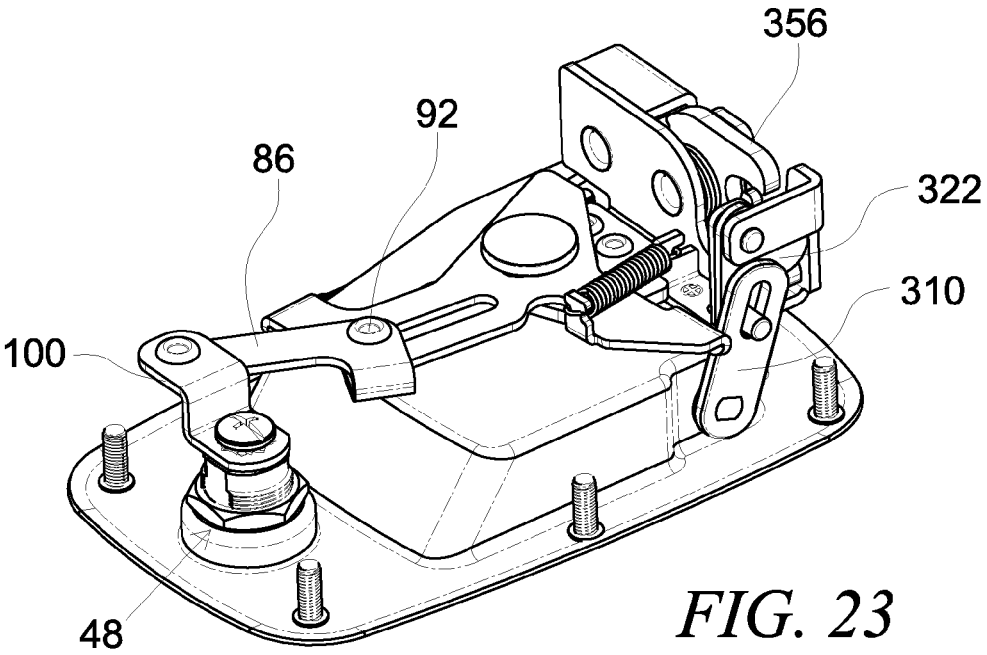
FIG. 23 is a rear bottom isometric view showing an assembled view of the paddle latch of FIG. 17 in its key unlocked, rotary latch completely closed, paddle handle lowered state.

FIG. 23 is a rear bottom isometric view and FIG. 23A is a bottom view showing an assembled view of the paddle latch 300 in its key unlocked, rotary latch completely closed, paddle handle 12 lowered state. In this state the key lock 48 is turned, thereby turning the key lock cam 100, which pulls on the linkage arm 86. Still, since the rotary hook 356 is in its completely locked state, the pin trigger cam 322 will not push on the pin trigger 310, thereby keeping the paddle handle 12 in its down position.

Figure 24A:
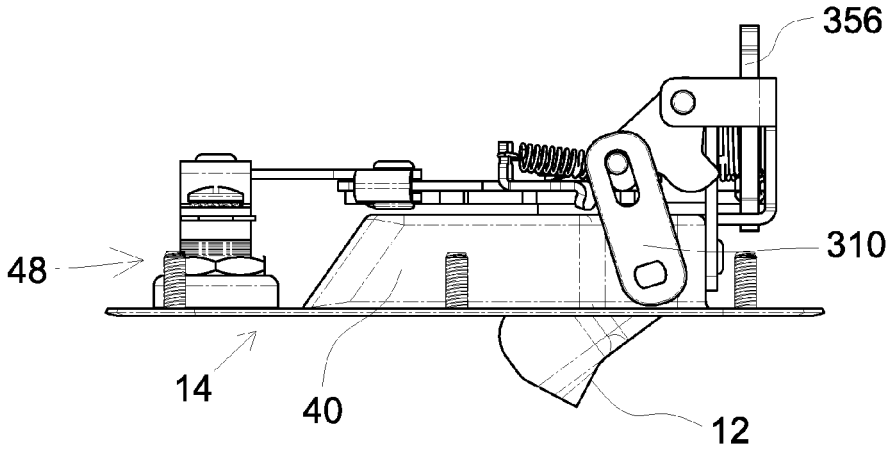
FIG. 24A is a bottom view showing the rotary latch of the paddle latch in its state of FIG. 24.
Figure 24:
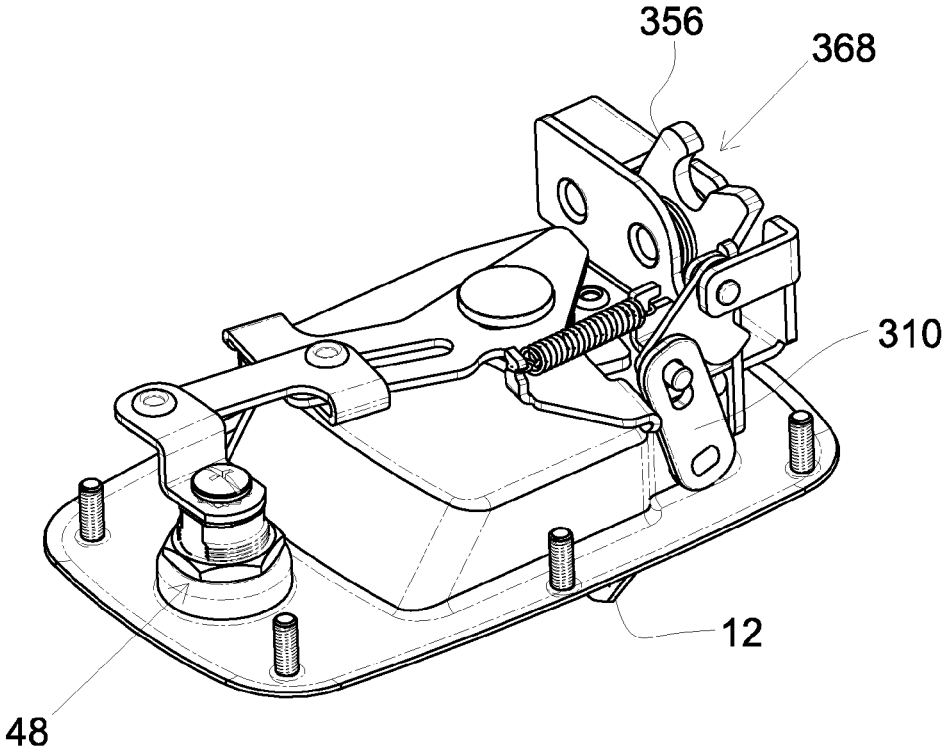
FIG. 24 is a rear bottom isometric view showing an assembled view of the paddle latch of FIG. 17 in its key unlocked, rotary latch opened, paddle handle fully raised state.
Figure 24B:
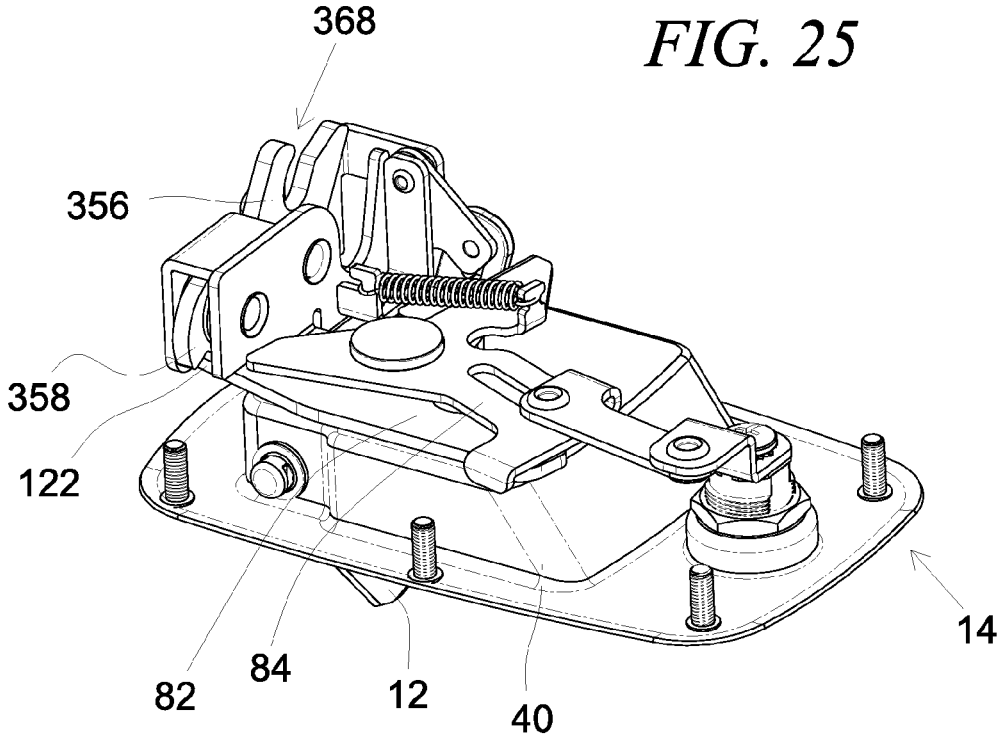
FIG. 24B is a rear top isometric view showing an assembled view of the paddle latch of FIG. 17 in its key unlocked, rotary latch opened, paddle handle fully raised state.

FIG. 24 is a rear bottom isometric view and FIG. 24A is a bottom view showing an assembled view of the paddle latch 300 in its key unlocked, rotary latch 16 opened, paddle handle 12 fully raised state after the paddle handle 12 is lifted. FIG. 24B is a rear top isometric view of the paddle latch 300 in this same state. In these views of the paddle latch 300, the paddle handle 12 is pulled out of the well 40 of the pan 14, causing the pin trigger 310 to push on the cam arm 84 which rotates the trigger arm 82, causing its trigger leg 122 to push on the rotary trigger 358, which then releases the rotary hook 356 so that its mouth 368 is facing generally upwardly and available to receive a catch (not shown).

Figure 25:
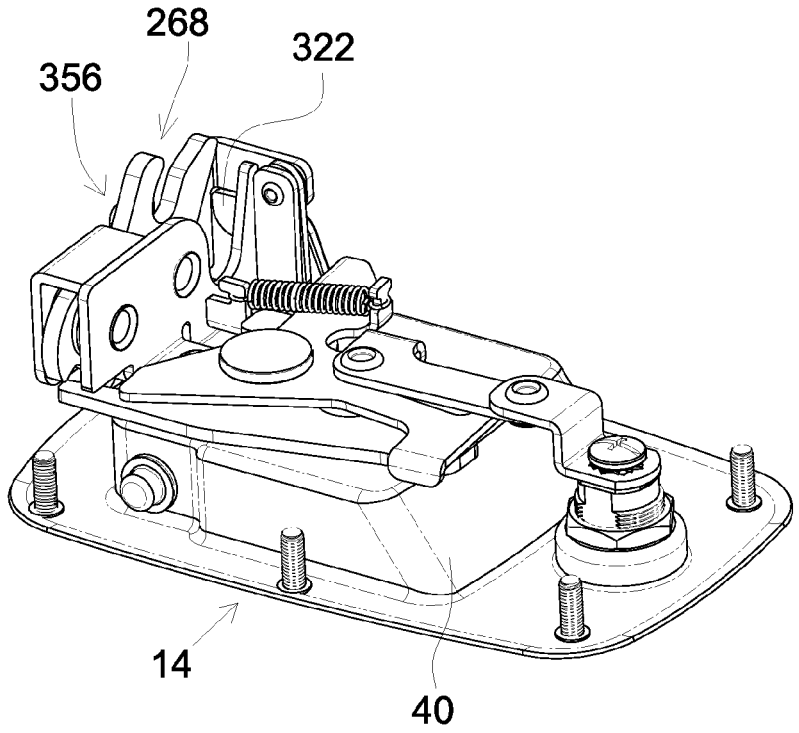
FIG. 25 is a rear top isometric view showing an assembled view of the paddle latch of FIG. 17 in its key locked, rotary latch opened, paddle handle lowered state.

FIG. 25 is a rear top isometric view showing an assembled view of the paddle latch 300 in its key locked, rotary latch opened, paddle handle lowered state, after the user releases the paddle handle so that it returns to a position where it is lowered down into the well 40 of the pan 14. In this position with the rotary hook 356 tilted up with its mouth 368 facing generally upwardly, the pin trigger cam 322 is rotated completely back into a position in the housing. As previously described, when the rotary hook 356 is tilted up with its mouth 368 facing generally upwardly, the door to which the paddle latch 300 is attached will be in an obviously open state, as opposed to a state, such as shown in FIGS. 19 and 20, where the rotary hook 356 is only partially closed.

Rivets that pass through holes on the various arms, cams, and levers have been described herein as providing for pivoting of various parts relative to each other. However, other types of pivots can be used, including nuts and bolts, pins, etc. Although the paddle latches 10 and 300 are shown including a key lock 48, in versions of the rotary latches, the key lock 48, cam 100, and linkage arm 88 and rivet 92 can be left out of the design and instead of having a separate trigger arm 82 and cam arm 84 that are pivoted to the pan 14 and can be forced to move in concert by the position of the linkage arm 88 and rivet 92, the trigger arm 82 and cam arm 84 can be combined into a single arm that includes a trigger leg that activates the rotary latch 16 in response to a user lifting the handle 12.

The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described.

What is claimed is:

1. A paddle latch, comprising:

a pan with a well;

a paddle handle;

a handle pivot including a pin that non-rotatably engages with the paddle handle to pivotally attach the paddle handle in the well of the pan, and a pin trigger that is retained outside of the well, the pin trigger having an elongate slot formed therein;

a rotary latch portion comprising a rotary hook with a mouth, a rotary trigger, springs to bias the rotary hook and rotary trigger, a housing for the rotary hook, and a pin trigger cam in the form of a generally planar plate that is pivotally connected to the housing generally perpendicularly to the rotary hook, the pin trigger cam having a bar extending generally perpendicularly at one end of the planar plate and a slanted edge on another end, wherein the bar extends through the elongate slot in the handle pivot, wherein the rotary trigger retains the rotary hook in one of a plurality of positions including an open position where the mouth of the rotary hook is accessible from outside of the housing, a semi-closed position, and a completely closed position, wherein in the semi-closed position and the completely closed position the mouth is blocked by the housing; and a trigger arm arrangement pivotally attached to the pan and adapted to transfer pivotal movement of the paddle handle to the rotary trigger of the rotary latch portion to release the rotary hook from the semi-closed position or the completely closed position to the open position;

wherein when the rotary hook is in the semi-closed position the rotary hook will impinge on the slanted edge of the pin trigger cam causing the pin trigger cam to rotate and rotate the pin trigger of the handle pivot to thereby cause the handle pivot to rotate, thereby partially tilting the paddle handle out from the well of the pan without being manually lifted by a user, and wherein when the rotary hook is in either the opened position or the completely closed position, the rotary hook will not impinge on the pin trigger cam and therefore the paddle handle will not be tilted out from the well of the pan.

2. The paddle latch of claim 1, further comprising a key lock with a key lock cam, and wherein the trigger arm arrangement comprises:

a trigger arm having a plate with a trigger arm pivot for pivotally attaching attachment of the trigger arm to the pan, an elongate activation leg having leading edge and a trailing edge, the elongate activation leg being wider at a terminal end and having a relief formed on the trailing edge closer to the trigger arm pivot, and a trigger leg that extends on an opposite end of the trigger arm pivot;

a cam arm having a generally planar body, a cam arm pivot for pivotally attachment of the cam arm to the pan, an elongate slot formed in the generally planar body with a first end and a second end, the first end being closer to the cam arm pivot, the cam arm having a first extension arm and a second extension arm, the first extension arm extending nearer the second end of the elongate slot and having a turned down pull tab that is adapted to engage with the leading edge of the elongate activation leg at its wider end, the second extension arm being on an opposite side of the cam arm pivot and being adjacent to the pin trigger of the handle pivot, the cam arm pivot and the trigger arm pivot being on a same axis; and a linkage arm having a first pivot end and second pivot end, the first pivot end being pivotally connected to the key lock cam and the second pivot end being slideably retained in the elongate slot in the cam arm;

wherein with the key lock cam in a locked position, the second end of the linkage arm will be at first end of the elongate slot in which position rotational movement of the cam arm will move the second pivot end into the relief in the trailing edge of the trigger arm so that the trigger arm is not rotated, whereas with the key lock cam in an unlocked position, the second end of the linkage arm will be at a second end of the elongate slot, in which position the turned down pull tab of the first extension arm of the cam arm will engage with and capture the leading edge of the wider end of the elongate activation leg of the trigger arm so that rotational movement of the cam arm rotates the trigger arm and causes the trigger arm to trigger the rotary trigger to disengagement from the rotary hook thereby allowing it to move to its opened position.

3. The paddle latch of claim 2, wherein the trigger arm pivot and the cam arm pivot comprise holes, and wherein the trigger arm and cam arm are pivotally attached to the pan by a rivet that passes through the holes in the trigger arm and cam arm.

4. The paddle latch of claim 2, further comprising a cam arm spring which is attached at a first end to the rotary latch portion and at a second end to the cam arm, which cam arm spring biases the second extension arm towards the rotary latch portion.

5. The paddle latch of claim 1, wherein the rotary trigger and the rotary hook are generally flat plates and wherein the rotary trigger and rotary hook are rotationally biased in opposite directions by the springs in the housing, and wherein the rotary hook has a first step and a second step formed on an edge of the flat plate generally opposite the mouth, and wherein the rotary trigger has a nose that will engage with one of the two steps of the rotary hook, the rotary trigger further including a trigger finger that extends outside of the housing of the rotary latch, which trigger finger is accessible to be triggered by the trigger arm arrangement, wherein when the nose of the rotary trigger is not engaged with either of the step steps, the rotary hook will be in the open position wherein its mouth is accessible from outside of the housing, and wherein when the nose of the rotary trigger is engaged with the first step, the rotary hook will be in the semi-closed position wherein the mouth is blocked by the housing and is partially swung down into the housing; and wherein when the nose of the rotary trigger is engaged with the second step, the rotary hook will be in the completely closed position wherein the mouth is blocked by the housing and is completely swung down into the housing.

6. The paddle latch of claim 1, further comprising seals positioned on pin of the handle pivot which seals bear against the pan and paddle handle to provide for weatherproofing of the paddle latch.

7. A paddle latch, comprising:

a pan with a well;

a paddle handle;

a handle pivot including a pin that non-rotatably engages with the paddle handle to pivotally attach the paddle handle in the well of the pan, and a pin trigger that is retained outside of the well;

a rotary latch portion comprising a rotary hook with a mouth, a rotary trigger, springs to bias the rotary hook and rotary trigger, a pin trigger cam, and a housing for the rotary hook, the rotary trigger, and the springs, wherein the rotary trigger retains the rotary hook in one of a plurality of positions including an open position where the mouth of the rotary hook is accessible from outside of the housing, a semi-closed position, and a completely closed position, wherein in the semi-closed position and the completely closed position the mouth is blocked by the housing, and wherein the pin trigger cam is pivotally connected to the housing generally perpendicularly to the rotary hook, the pin trigger cam having a nose on one side and a slanted edge on another side, and wherein the pin trigger cam is aligned with the rotary hook such that when the rotary hook is in the semi-closed position the rotary hook will impinge on the slanted edge of the pin trigger cam causing the pin trigger cam to rotate and engage with the nose of the pin trigger cam against the pin trigger of the handle pivot to cause the pin to rotate, thereby partially tilting the paddle handle out from the well of the pan without being manually lifted by a user, and wherein when the rotary hook is in either the opened position or the completely closed position, the pin will not engage with the pin trigger and therefore the paddle handle will not be tilted out from the well of the pan; and a trigger arm arrangement pivotally attached to the pan and adapted to transfer pivotal movement of the paddle handle to the rotary trigger of the rotary latch portion to release the rotary hook from the semi-closed position or the completely closed position to the open position;

wherein when the rotary hook is in the semi-closed position, the paddle handle will be partially tilted out from the well of the pan without being manually lifted by a user, and wherein when the rotary hook is in either the open position or the completely closed position, the paddle handle will not be partially tilted out from the well of the pan.

8. A paddle latch, comprising:

a pan with a well and a rim, the pan having an upper surface and a lower surface;

a paddle handle with a pivot end with a non-round hole formed therethrough, and a grip portion opposite the pivot end;

key lock with a key lock cam, the key lock located in the rim of the pan and the key lock cam extending below the lower surface of the pan;

a handle pivot including a non-round pin that non-rotatably passes through the non-round hole formed in the pivot end of the paddle handle to pivotally attach the paddle handle in the well of the pan, and a pin trigger that is retained outside of the well on the lower surface thereof;

a rotary latch portion affixed to the lower surface of the pan, comprising a rotary hook with a mouth, a rotary trigger, springs to bias the rotary hook and rotary trigger, a pin trigger cam, and a housing for the rotary hook, the rotary trigger, and the springs, wherein the rotary trigger retains the rotary hook in one of a plurality of positions including an open position where the mouth of the rotary hook is accessible from outside of the housing, a semi-closed position, and a completely closed position, wherein in the semi-closed position and the completely closed position the mouth is blocked by the housing, and wherein the pin trigger cam is pivotally connected to the housing generally perpendicularly to the rotary hook, the pin trigger cam having a nose on one side and a slanted edge on another side, wherein the pin trigger cam is aligned with the rotary hook such that when the rotary hook is in the semi-closed position the rotary hook will impinge on the slanted edge of the pin trigger cam causing the pin trigger cam to rotate and engage with the nose of the pin trigger cam against the pin trigger of the handle pivot to cause the pin to rotate, thereby partially tilting the paddle handle out from the well of the pan without being manually lifted by a user, and wherein when the rotary hook is in either the opened position or the completely closed position, the pin will not engage with the pin trigger and therefore the paddle handle will not be tilted out from the well of the pan; and a trigger arm arrangement pivotally attached to the pan adapted to transfer pivotal movement of the paddle handle to the rotary trigger of the rotary latch portion to release the rotary hook from the semi-closed position or the completely closed position so the rotary hook moves to the open position;

wherein when the rotary hook is in the semi-closed position, the paddle handle will be partially tilted out from the well of the pan without being manually lifted by a user, and wherein when the rotary hook is in either the opened position or the completely closed position, the paddle handle will not be partially tilted out from the well of the pan.

* * * * *